US009951729B2

(12) United States Patent
Fukui et al.

(10) Patent No.: US 9,951,729 B2
(45) Date of Patent: Apr. 24, 2018

(54) FUEL SUPPLY DEVICES

(71) Applicant: AISAN KOGYO KABUSHIKI KAISHA, Obu-shi, Aichi-ken (JP)

(72) Inventors: Tatsuki Fukui, Nagoya (JP); Koji Yoshida, Kasugai (JP); Kensuke Niwa, Nagoya (JP); Shinya Higashi, Kasugai (JP); Yuichi Murakoshi, Inazawa (JP); Hidetomo Ishida, Nagoya (JP); Hiroyasu Kariya, Kariya (JP); Hironori Tanikawa, Anjo (JP); Takuhito Fujiwara, Obu (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 0 days.

(21) Appl. No.: 15/505,647

(22) PCT Filed: Aug. 10, 2015

(86) PCT No.: PCT/JP2015/072659
§ 371 (c)(1),
(2) Date: Feb. 22, 2017

(87) PCT Pub. No.: WO2016/031545
PCT Pub. Date: Mar. 3, 2016

(65) Prior Publication Data

US 2017/0268471 A1 Sep. 21, 2017

(30) Foreign Application Priority Data

Aug. 26, 2014 (JP) ..... 2014-171445

(51) Int. Cl.
*F02M 37/10* (2006.01)

(52) U.S. Cl.
CPC ..... *F02M 37/103* (2013.01)

(58) Field of Classification Search
CPC ..... F02M 37/10; F02M 37/37103; F02M 37/0017; F02M 37/00
See application file for complete search history.

(56) References Cited

U.S. PATENT DOCUMENTS 4,945,884 A 8/1990 Coha et al.
6,206,037 B1 3/2001 Murakoshi et al.
(Continued)

FOREIGN PATENT DOCUMENTS

JP H11-324843 A 11/1999
JP H11324843 A 11/1999
JP 2012-184760 A 9/2012

OTHER PUBLICATIONS

International Patent Application No. PCT/JP2015/072659 International Search Report dated Nov. 10, 2015 (3 pages).
(Continued)

*Primary Examiner* — Hieu T Vo
(74) *Attorney, Agent, or Firm* — Conley Rose, P.C.

(57) ABSTRACT

A fuel supply device has a cover member which is attached to an opening of a fuel tank, a pump unit comprising a pump, and a connecting portion configured to connect the cover member and the pump unit. A connecting shaft which is formed to one of the two connected members of the connecting portion is inserted into a connecting hole which is formed to the other of the two such that the pump unit is connected to be relatively movable to the connecting portion. The pump unit includes an upper base on which the pump is placed, and a lower base which contacts to the fuel tank. The upper base and the lower base are coupled through attachments whereby an engagement portion of the upper base is fitted into a recessed portion formed on the side of the lower base. The recessed portion has a pair of planes opposing to each other and oriented toward a bottom surface of the lower base from a predetermined position. The
(Continued)

recessed portion is further configured such that an interval between a pair of the planes is gradually increased toward the bottom surface.

20 Claims, 17 Drawing Sheets

(56) References Cited

U.S. PATENT DOCUMENTS

| | | | | |
|---|---|---|---|---|
| 6,308,733 | B2 | 10/2001 | Murakoshi et al. | |
| 6,401,751 | B2 | 6/2002 | Murakoshi et al. | |
| 6,672,288 | B1 * | 1/2004 | Schelhas ..... | B01D 35/027 123/509 |

OTHER PUBLICATIONS

Japanese Office Action dated Nov. 7, 2017, for Japanese Application No. 2014-171445 (4 p.).
English Translation of Japanese Office Action dated Nov. 7, 2017, for Japanese Application No. 2014-171445 (3 p.).

* cited by examiner

"PRIOR ART"

FUEL SUPPLY DEVICES

CROSS-REFERENCE TO RELATED APPLICATIONS

The present application is a National Phase entry of, and claims priority to, PCT Application No. PCT/JP2015/072659, filed Aug. 10, 2015, which claims priority to Japanese Patent Application No. 2014-171445, filed Aug. 26, 2014, both of which are incorporated by reference herein in their entireties for all purposes.

STATEMENT REGARDING FEDERALLY SPONSORED RESEARCH OR DEVELOPMENT

Not applicable.

BACKGROUND

The present invention relates to a fuel supply device. In particular, the invention relates to a fuel supply device for supplying fuel within a fuel tank to an internal combustion engine, wherein the fuel supply device is mounted to a vehicle, e.g. an automobile.

Fuel supply devices mounted to fuel tanks are widely known in the art. It is also widely known that a part of these fuel supply devices can be inserted from an opening formed in an upper surface portion of the fuel tank, where the device attaches to said opening when the fuel supply device is mounted to the fuel tank. Further, as disclosed in a Japanese Laid-Open Patent Publication No. 2012-184760 (hereinafter referred to as 760 Publication), a pump unit rotatably provided to a fuel supply device is also known.

BRIEF SUMMARY

However, the prior art disclosed in 760 Publication can still be further improved. According to the fuel supply device disclosed in 760 Publication, the pump unit is passed through an opening of a fuel tank while being laterally moved, however, in this way the fuel supply device may not move smoothly because the fuel supply device can get stuck near the opening during the movement. For example, a recessed portion formed on the side of a lower base could easily get stuck on an edge of the opening (see FIG. 31). Further, a leading end of a rod member, which is attached to a cover member, could get stuck on an edge around the opening of the fuel tank or in a resin ring arranged around the opening. Consequently, substantial time and extraneous effort may be required for attaching the supply device to the fuel tank.

Therefore, there is a need for an improved fuel supply device, which may be smoothly inserted into the fuel tank.

According to one aspect of the present invention, the fuel supply device comprises a cover member which is attached to an opening of a fuel tank as well as a pump unit having a pump, and a connecting portion for connecting the cover member and the pump unit. The pump unit can be connected so as to be relatively movable to the connecting portion when a connecting shaft, which is formed as part of one of the connecting portion or the pump unit, is inserted into a connecting hole which is formed as part of the other of the two. The pump unit includes an upper base on which the pump is placed, and a lower base which contacts to the fuel tank. The upper base and the lower base are coupled by way of an engagement portion of the upper base fitting into a recessed portion formed on the side of the lower base. The recessed portion has a pair of planes opposing to each other and oriented toward a bottom surface of the lower base from a predetermined position. The recessed portion is configured such that an interval between a pair of the planes gradually increases toward the bottom surface.

As a result of these structural aspects, the instances of the fuel supply device getting caught on the edge around the opening greatly diminish. For example, when the improved fuel supply device is inserted, the edge around the opening in contact with the recessed portion is guided to an angular plane, which is gradually widened toward the bottom surface, so as to be removed from and not get stuck with the recessed portion. Therefore, the pump unit can be easily inserted into the opening of the fuel tank.

According to another aspect of the present invention, a step is formed on an upper surface side of the upper base, and a guide portion is provided for preventing component constituting the step from being stuck on the edge around the opening of the fuel tank.

Therefore, although the step is formed on the upper surface of the upper base, the pump unit through the guide portion is prevented from being caught on the edge around the opening of the fuel tank. Accordingly, the fuel supply device can be smoothly attached to the fuel tank.

According to another aspect of the present invention, the guide portion of the previous aspect has an inclined surface inclined with respect to a bottom surface of the lower base.

Therefore, when the pump unit is moved while the inclined surface abuts the edge around the opening, the pump unit can be smoothly inserted into the opening. In particular, the pump unit may be moved downwardly while being moved in a lateral direction due to the degrees of freedom allowed by the inclined surface when the pump unit is moved from the opening of the fuel tank toward a bottom.

According to another aspect of the present invention, the connecting portion includes a rod member with one end connected to a cover member and a joint which is connected to the rod member and slidably movable along the rod member in the vertical direction. The leading end of the rod member is positioned above a lower end of the joint when the joint is positioned at a lower end position.

Therefore, when the joint is positioned at said lower end position, a leading end of the rod does not extend below the joint. Consequently, the leading end of the rod is prevented from being caught on a seal member etc., which is disposed in the vicinity of the opening. As a result, via the lower end position of the joint, the fuel supply device may be smoothly attached to the fuel tank.

According to another aspect of the invention, the joint includes a guide surface inclined to an axis of the rod member. The pump unit can be moved toward a predetermined position when the joint moves as the guide surface abuts the fuel tank.

Therefore, due to the presence of said guide surface, the pump unit can be moved toward the predetermined position. Consequently, the fuel supply device may be smoothly attached to the fuel tank.

According to another aspect of the present invention, the connecting portion includes a rod member with one end connected to the cover member and a joint which is slidably connected to the rod member where a lower end of the rod member is formed as a curved surface.

As a result, due to the curved manner of construction, the lower end of the rod member may be prevented from adversely interacting with the seal member, getting caught/stuck on said member, etc., where the seal member is disposed around the opening of the fuel tank.

According to another aspect of the present invention, the fuel supply device's structural design accounts for it being inserted into the fuel tank while being moved in a leftward or rightward direction. For example, the length of the pump unit may be formed to be longer than the opening of the fuel tank. More particularly, a projection geometry of the pump unit into a horizontal surface extends beyond the opening of the fuel tank when the fuel supply device is lifted while the cover member is held.

Therefore, the configuration flexibility of the fuel supply device may be increased since the fuel supply device is required to be inserted while being displaced in a leftward or rightward direction when attached to the fuel tank. However, various parts of the fuel supply device may abut various parts of the fuel tank. Accordingly, because of having any one of the above aspects, the fuel supply device is prevented from being stuck on various parts within the fuel tank.

According to another aspect of the present invention, the fuel supply device comprises a cover member which is attached to an opening of a fuel tank, a pump unit having a pump, and a connecting portion for connecting the cover member and the pump unit. The pump unit can be connected so as to be relatively movable to the connecting portion when a connecting shaft which is formed as part of one of the connecting portion or the pump unit, is inserted into the connecting hole which is formed as part of the other of the two. A step is formed on an upper surface side of the pump unit, and a guide portion is provided for preventing the component constituting the step from being stuck on the edge of the opening around the fuel tank. The guide portion has an inclined surface inclined with respect to a bottom surface of the pump unit.

Therefore, although the step is formed on the upper surface of the pump unit, the pump unit is prevented from being stuck on the edge around the opening of the fuel tank because the guide portion is provided. Accordingly, the fuel supply device can be smoothly attached to the fuel tank.

According to another aspect of the present invention, the fuel supply device includes a cover member which is attached to an opening of a fuel tank, a pump unit having a pump, and a connecting portion for connecting the cover member and the pump unit. The pump unit can be connected so as to be relatively movable to the connecting portion when a connecting shaft which is formed as part of one of the connecting portion or the pump unit, is inserted into the connecting hole which is formed as part of the other of the two. The connecting portion includes a rod member with one end connected to a cover member and a joint which is connected to the rod member and slidably movable along the rod member in the vertical direction. The leading end of the rod member is positioned above a lower end of the joint when the joint is positioned at a lower end position.

Therefore, when the joint is positioned at the lower end position, the leading end of the rod does not extend below the joint. Consequently, the leading end of the rod is prevented from being caught on a seal member etc., which is disposed in the vicinity of the opening. As a result, via the lower position of the joint, the fuel supply device may be smoothly attached to the fuel tank.

According to another aspect of the present invention, the fuel supply device includes a cover member which is attached to an opening of a fuel tank, a pump unit having a pump, and a connecting portion for connecting the cover member and the pump unit. The pump unit can be connected so as to be relatively movable to the connecting portion when a connecting shaft which is formed as part of one of the connecting portion or the pump unit, is inserted into the connecting hole which is formed as part of the other of the two. The connecting portion includes a rod member with one end connected to a cover member and a joint which is slidably connected to the rod member while a lower end of the rod member is formed as a curved surface.

As a result, the lower end of the rod member may be prevented from adversely interacting with the seal member, getting caught/stuck on said member, etc., where the seal member is disposed around the opening of the fuel tank.

DETAILED DESCRIPTION

Figure 1:
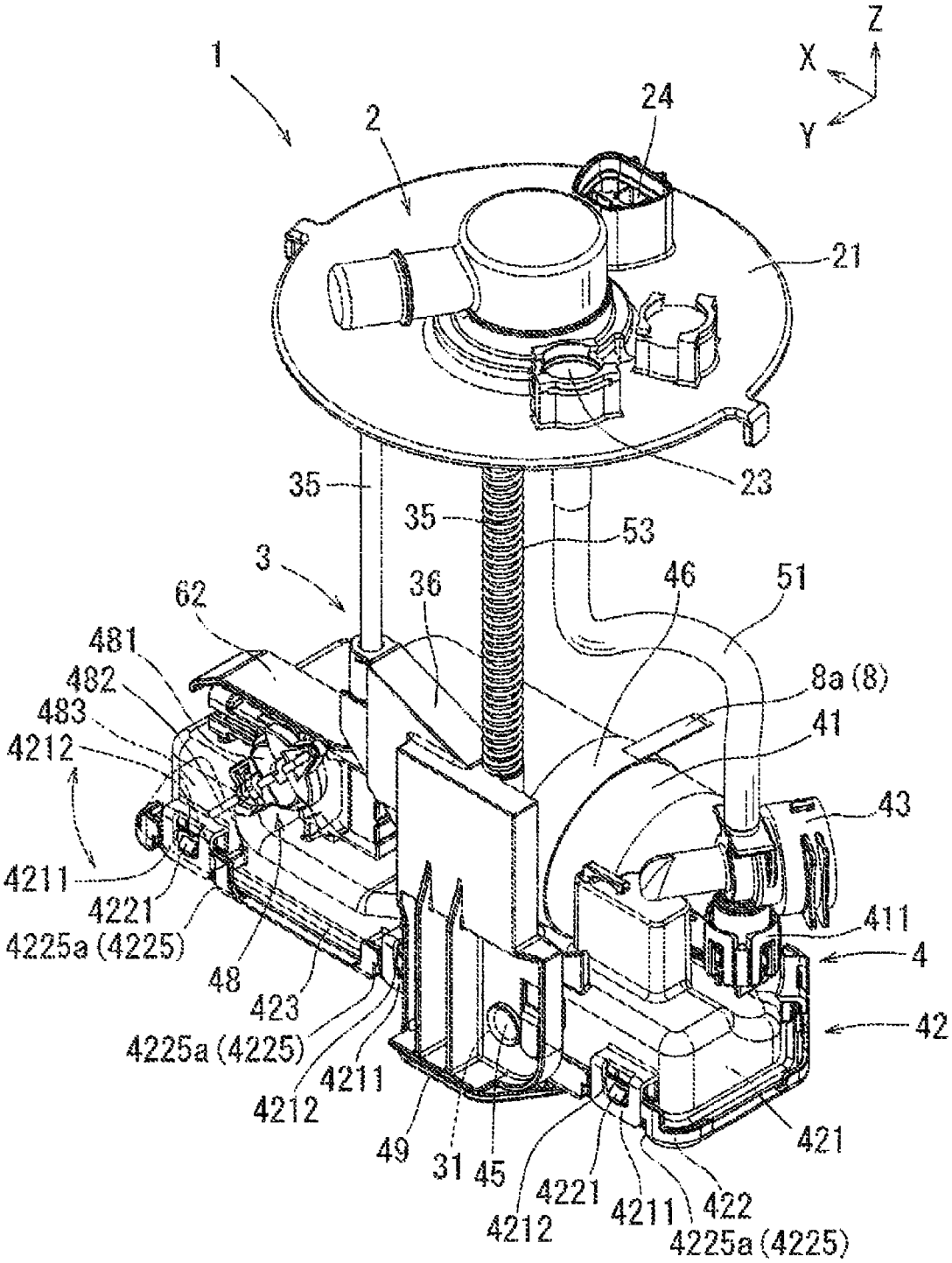
FIG. 1 is a perspective view of a fuel supply device according to one embodiment of the present invention.

Hereinafter, one exemplary embodiment of the present invention will now be described with reference to the drawings. The forward and backward directions, upward and downward directions as well as leftward and rightward directions in the present specification are determined such that X is a forward direction, Y is a leftward direction and Z is an upward direction as shown in FIG. 1, where the backwards, upwards, and downwards directions extend in the negative direction of X, Y, and Z, respectively. For example, normally a cover member 2 of a fuel supply device 1 is positioned at an upper side and a pump unit 4 is positioned at a lower side, below the cover member. A rotary axis of the pump unit 4 extends in the leftward and rightward directions. The forward and backward directions are orthogonal to the leftward and rightward directions as well as to the upward and downward directions. Hereinafter, unless otherwise specifically noted, the directions are referred to as assuming that the fuel supply device 1 is attached to the tank 7 as shown in FIG. 27.

The fuel supply device 1 according to the present embodiment may be mounted on a vehicle, such as an automobile. The fuel supply device 1 is attached to a fuel tank 7 arranged below a floor of the vehicle. The fuel supply device 1 is used to feed liquid fuel stored within the fuel tank 7 to an internal combustion engine (not shown).

Figure 27:
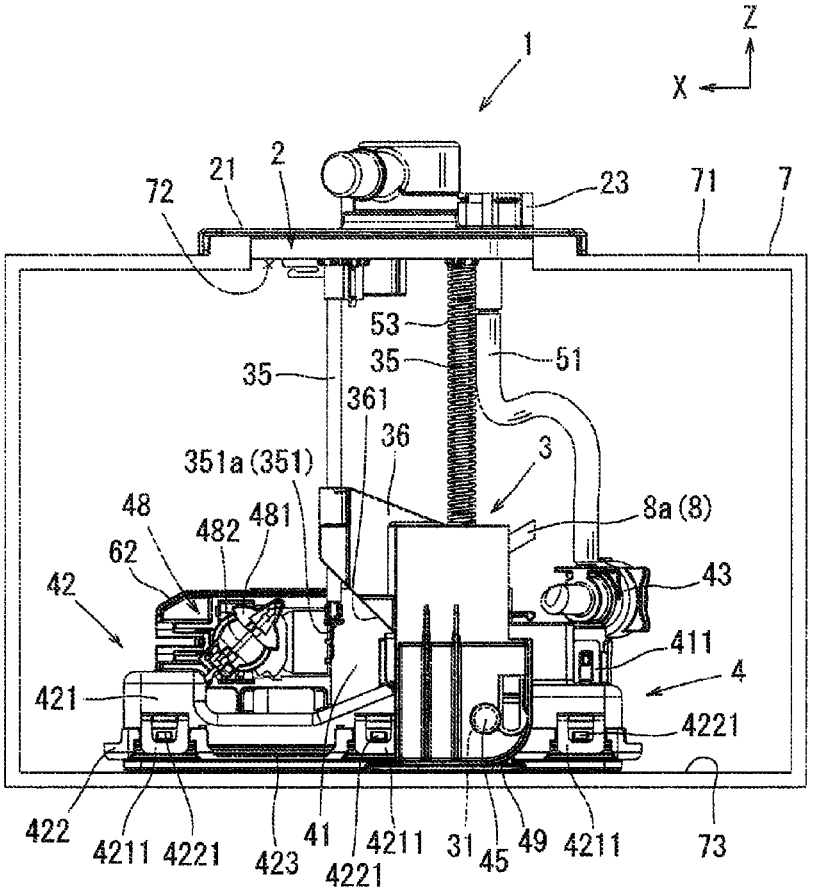
FIG. 27 is a side view illustrating a state when the fuel supply device is attached to the fuel tank.

As shown in FIG. 27, the fuel supply device 1 according to the present embodiment, has the cover member 2 attached to an opening 72 formed within an upper surface portion 71 of the fuel tank 7 and a pump unit 4 with a pump 41, which may be used for feeding fuel within the fuel tank 7 to the outside. Further, the fuel supply device 1 includes a connecting portion 3 used for connecting the cover member 2 with the pump unit 4, and a fuel residual amount detection device 48 for detecting the residual amount of fuel stored in the fuel tank 7. The pump unit 4 is installed at a bottom surface 73 of the fuel tank 7 and the cover member 2 is attached to the opening 72 of the fuel tank 7. The cover member 2 can close the opening 72 of the fuel tank 7 and press the pump unit 4 in touching contact along the bottom surface 73 of the fuel tank 7.

As shown in FIG. 27, the cover member 2 includes a set plate portion 21, which covers the opening 72 of the fuel tank 7. An outlet port 23 is provided on the substantially disk-shaped set plate 21 for leading fuel delivered from the pump unit 4 to the outside of the fuel tank 7. Further, the set plate portion 21 includes an electric connector 24 for connecting electric wiring shown in FIG. 1. The opening 72 normally has a circular shape, and the set plate portion 21 has a substantially circular shape in plan view, which is concentric with and thus corresponds to the shape of the opening 72. A ring made of resin (not shown), such as an O-ring, is attached to the opening 72 as a sealing member. The ring serves to fill a clearance between the fuel tank 7 and the cover member 2 in order to reduce or eliminate the clearance.

Figure 2:
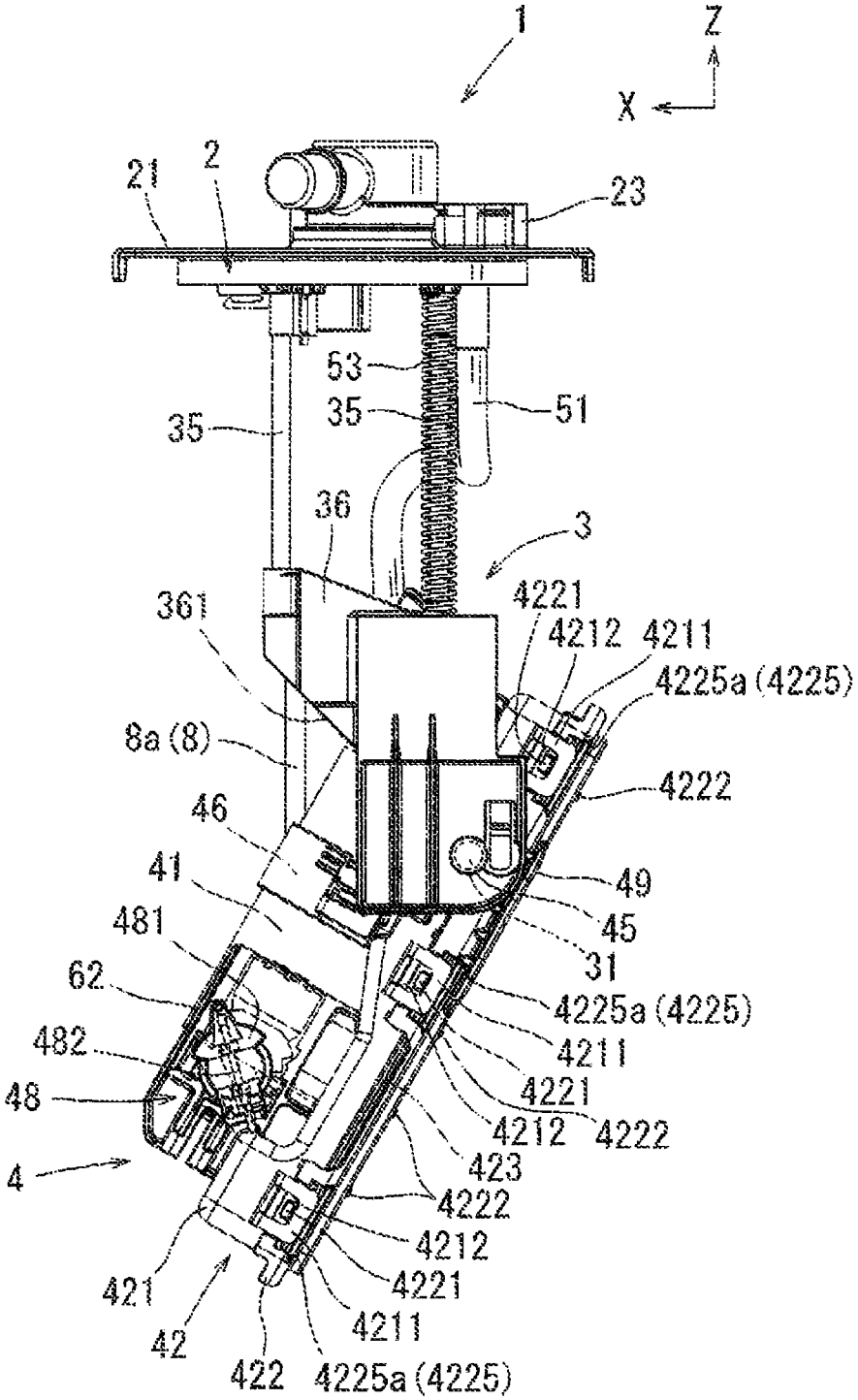
FIG. 2 is a side view in a state when the fuel supply device of FIG. 1 is lifted.

The connecting portion 3 of the fuel supply device 1 shown in FIGS. 1 and 2 is telescopic, and can be extended and retracted. The connecting portion 3 includes a rod member 35 attached to the cover member 2 and a joint portion 36 which is movable along the length of rod member 35. The rod member 35 extends in a direction orthogonal to the plane in which the set plate portion 21 extends radially. Further, a spring 53 that can exert elastic force is arranged between the joint portion 36 and the cover member 2. The spring 53 biases the cover member 2 to move away from the pump unit 4 whenever the cover member 2 and the pump unit 4 mutually approach closer than a predetermined distance. In this manner, the spring 53 is compressed while the cover member 2 is moved towards the bottom surface 73 of the fuel tank 7 from an existing state in which the bottom surface of the pump unit 4 contacts the bottom surface 73 of the fuel tank 7 (see FIG. 27). As long as this compressed state of the spring 53 is maintained, the pressed state of the pump unit 4 against the bottom surface 73 will also be maintained. In particular, biasing force from the compression of the spring 53 is transmitted downward from the connecting portion 3 to a connected engagement portion 49 provided at the pump unit 4 to press the engagement portion 49 against the bottom surface 73 of the fuel tank 7.

As shown in FIGS. 1 and 2, the pump unit 4 is arranged below the cover member 2. The pump unit 4 includes the pump 41 used for feeding fuel and a base portion 42 used for mounting the pump 41. The base portion 42 has a substantially flat planar shape and is arranged so that one lateral side surface of the base portion 42 faces the bottom surface 73 of the fuel tank 7 (see FIG. 27). The base portion 42 may also be referred to as a fuel reservoir or a sub-tank etc. The base portion 42 includes an upper base 421 to which the pump 41 is attached, a lower base 422 which is the one lateral side surface that faces and contacts the bottom surface 73 of the fuel tank 7, and a filter member 423 which is interleaved between the upper base 421 and the lower base 422. The upper base 421 is provided with a suction port (not shown) to be connected with the pump 41 and configured such that the fuel passed through the filter member 423 can be sucked by the pump 41.

The lower base 422 has an opening (bottom surface opening 4223 shown in FIG. 26) with a lattice. The lower base 422 comprises clearance-providing leg portions 4222 so that the fuel can be sucked from the bottom surface opening even when the lower base 422 is abutting the bottom surface 73 of the fuel tank 7. Further, an outer periphery of the upper base 421 is of a similar shape but smaller than an outer periphery of the lower base 422. A clearance is thus formed between the upper base 421 and the lower base 422 when the filter member 423, which formerly occupied the clearance, is not interleaved. The clearance space can serve to introduce fuel into the base portion 42. In this embodiment, thus, instead of interleaving, one surface of the upper base 421 is arranged so as to be covered by the filter member 423. As a result, the fuel entering from the unoccupied clearance into the base portion 42 also reaches the pump 41 through the filter member 423.

A pressure control valve 43 is attached to the pump unit 4 that is used for adjusting liquid feed pressure of the fuel. The pressure control valve 43 is attached to a valve supporting portion 411 extending from the pump 41. The fuel with adjusted pressure by the pressure control valve 43 is fed to the internal combustion engine, for example, via a hose 51 and the outlet port 23.

As shown in FIGS. 1 and 2, the fuel residual amount detection device 48 is attached to the base portion 42 of the pump unit 4. For example, it may be attached to the upper base 421 of the base portion 42. The fuel residual amount detection device 48 includes a gauge main body 481 to which electric wirings are connected, an arm portion 482 which is rotatably mounted relative to the gauge main body 481, and a float 483 which is attached to a free end of the arm portion 482. The float 483 is movable, where a position of the float 483 corresponds to the liquid level of fuel. Consequently, the position of the arm portion 482 is determined in accordance with the position of the float 483. According to the relative position of the arm portion 482 with respect to the gauge main body 481, the electric resistance value of the gauge main body 481 is determined such that fuel residual amount can ultimately be detected.

As shown in FIG. 1, the connecting shaft 45 provided through the pump unit 4 is inserted in the connecting hole 31 formed in the connecting portion 3, and extends through the pump unit 4 to connect the connecting portion 3 with the pump unit 4. Consequently, the connecting portion 3 and the pump unit 4 are connected via the connecting shaft 45 so as to be relatively movable. Thus, as shown in FIG. 2, the pump unit 4 rotates relative to the connecting portion 3 about the shaft 45 when the fuel supply device 1 is lifted while the cover portion 2 is held. At this time, one end of the base portion 42 of the pump unit 4 faces the bottom surface 73 of the fuel tank 7.

As shown in FIGS. 1 and 2, an engagement portion 49 capable of abutting to the connecting portion 3 is provided on the lower base 422 of the pump unit 4. The engagement portion 49 with a plate-like portion extends laterally in the Y-direction from the lower end of the lower base 422. The pump unit 4 can be pressed against the bottom surface 73 of the fuel tank 7 while the pump unit 4 is prevented from being inclined when this engagement portion 49 is pressed with the connecting portion 3.

As shown in FIG. 1, the upper base 421 and the lower base 422 are connected with engagement portions 4211 on the upper base 421 that are caught by counter engagement portions 4221 on the lower base 422, where the two respective portions form a complementary snap fit. More specifically, the lower base 422 and the upper base 421 are fixedly connected when both sides of the lower base 422 are clamped by flanges formed as part of the engagement portions 4211 of the upper base 421, forming multiple snap fit connections. The engagement portions 4211 are provided at six locations on the lateral surface of the upper base 421, while the counter engagement portions 4221 are provided at six locations of the lateral surface of the lower base 422. The resin engagement portions 4211 are configured to be elastically deformable so the flanges of said portions can form a complementary snap fit and be caught on protruding counter engagement portions 4221 (see FIG. 1).

Figure 3:
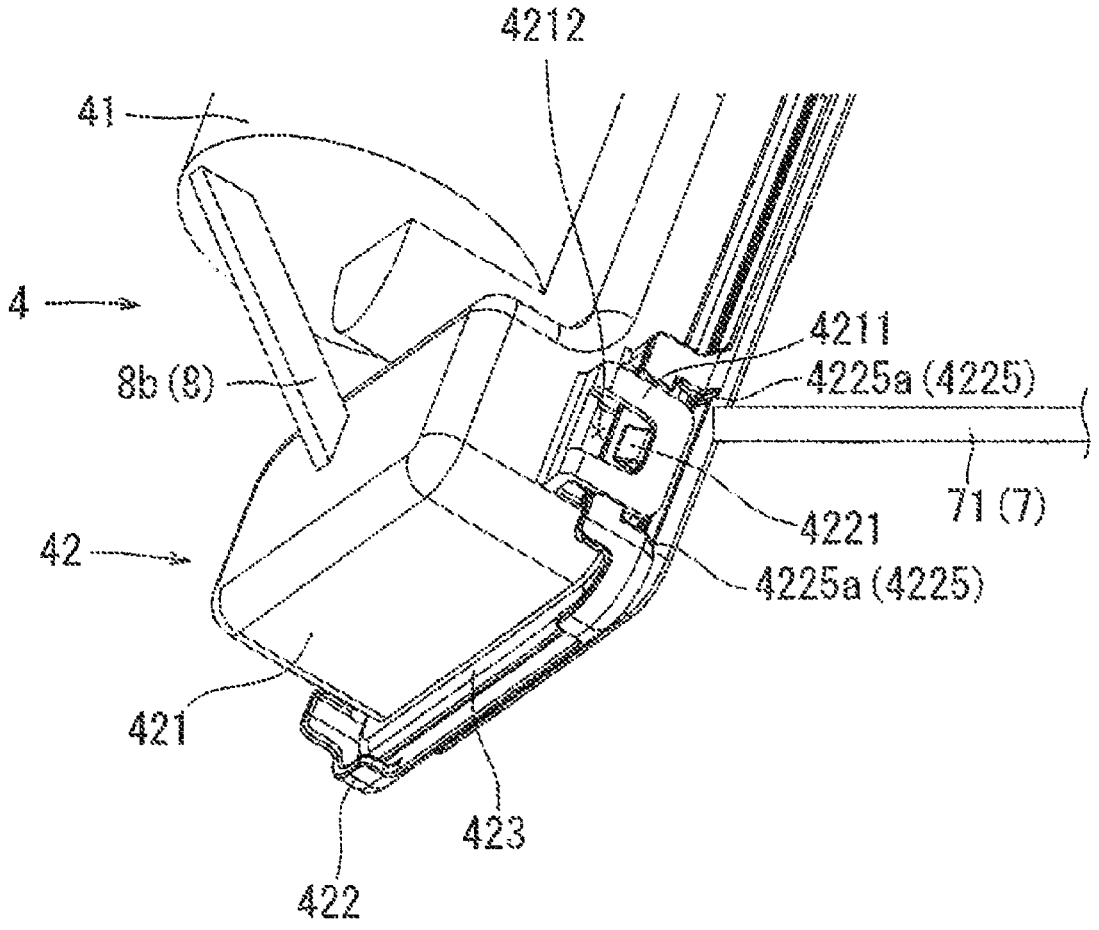
FIG. 3 is a partially enlarged view illustrating a state where a pump unit of FIG. 1 is inserted into an opening of a fuel tank.

As shown in FIGS. 1 and 3, the protruding portions (counter engagement portions 4221) are formed by providing recessed portions 4225*a* on the lateral surface of the lower base 422. The recessed portions 4225*a* are opened toward the bottom surface of the pump unit 4. The protruding portions are surrounded in the XZ plane by the recessed portions 4225*a*, and are configured such that the protruding portions can be inserted into holes 4212 formed by the flanges of the engagement portions 4211, into which the protruding portions can complementarily fit. When the protruding portions with this configuration are inserted into their corresponding holes 4212, the engagement portions 4211 are fitted fixedly to the recessed portions 4225*a*. Further, the device is configured so that when the engagement and counter engagement portions are in a complementary fit configuration, one lateral side of the engagement portion 4211 and one lateral side of the counter engagement portion 4221 can be positioned on the substantially same plane in the outward Y direction perpendicular to the XZ plane. Consequently, this prevents from forming recessed/protruding configuration toward the side of the base portion 42 in an outward Y direction even when the engagement portions 4211 and the counter engagement portions 4221 are fitted each other.

Figure 31:
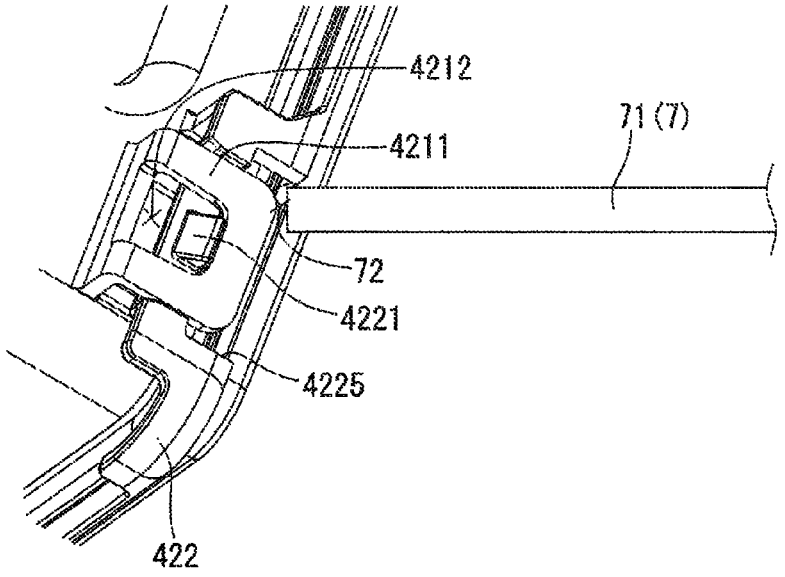
FIG. 31 is a partially enlarged view illustrating a state when a pump unit of prior art is inserted into an opening of a fuel tank.

As shown in FIG. 31, if the recessed portions 4225 of the prior art are formed to cross a groove which is intersecting the bottom surface of the lower base 422, the edge around the fuel tank opening 72 which is entered into by the recessed portion 4225 upon insertion of the fuel supply device into/out of the tank, may be stuck on by recessed portion 4225. Further, the protruding portions (counter engagement portions 4221) could be released from the holes 4212 if the pump unit 4 is forced to move while the catch is caused. This may be avoided if the pump unit 4 is carefully moved, however, it could inhibit the fuel supply device 1 to be attached to the fuel tank 7 quickly.

In order to avoid this circumstance, the width of the recessed portion 4225*a* in FIG. 3 is formed to increase gradually from a predetermined part towards the bottom surface. More specifically, a predetermined part of the recessed portion 4225*a* is configured to be of an isosceles trapezoid shape as seen from a side view. Therefore, the edge may be easily removed from the recessed portion 4225*a* even when the edge around the fuel tank opening 72 is entered into by the recessed portion 4225*a*. The predetermined part of the recessed portion 4225*a* is formed at the substantially same height in the Z direction as the lower end position of the engagement portion 4211, as seen in FIG. 3. In other words, the predetermined part is configured such that the height wise distance between a position of the lower end of the engagement portion 4211 and the bottom surface of the pump unit 4 will be substantially the same as the distance between the predetermined part and the bottom surface of the pump unit 4.

Figure 4:
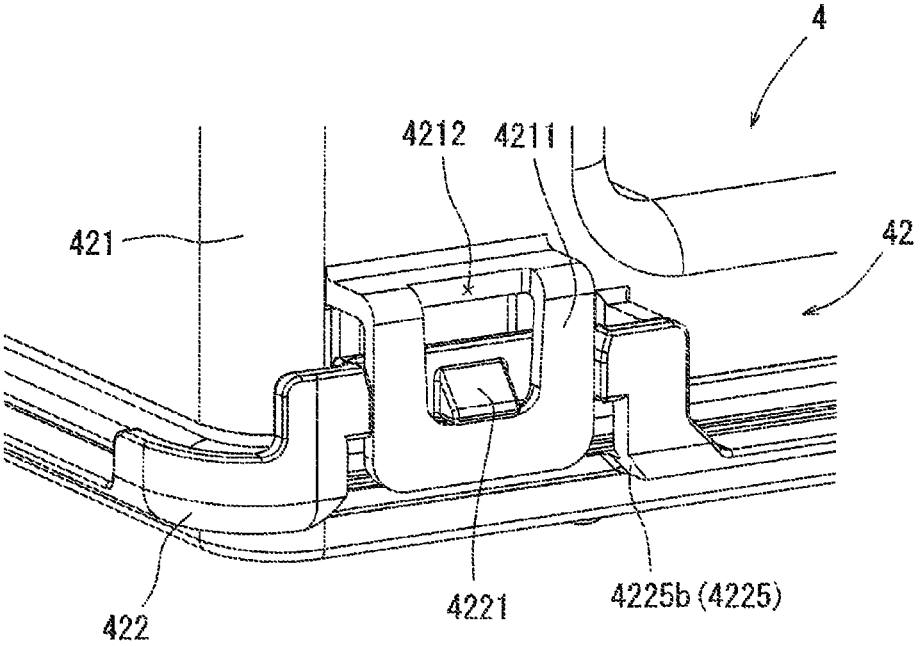
FIG. 4 is an enlarged view around an engagement portion and counter engagement portion of a fuel supply device according to one modification.
Figure 5:
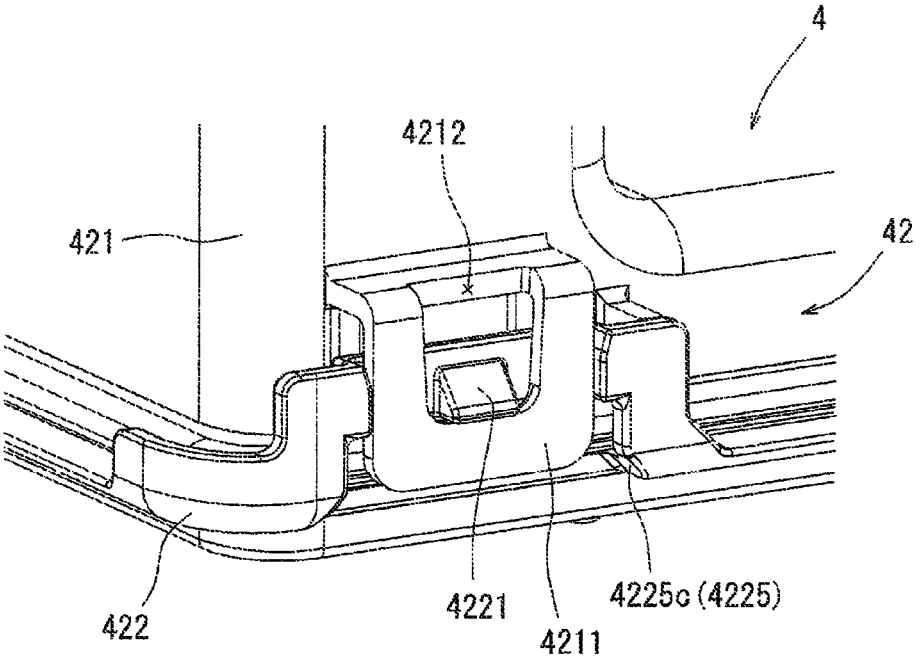
FIG. 5 is an enlarged view around an engagement portion and counter engagement portion of a fuel supply device according to another modification.

As shown in FIG. 3, the recessed portions 4225*a* are configured such that the outer peripheral edge around the surface of the predetermined part of the recessed portions to the surface facing the bottom surface are chamfered. However, other configurations are also possible. Instead of being chamfered, for example, as shown in FIG. 4, the recessed portions 4225*b* may be configured to have a surface forming a ridge angle between surfaces that are substantially orthogonal peripheral edge of the predetermined part of the recessed portion. Further, as another modification in FIG. 5, the outer peripheral edges of recessed portions 4225*c* may also be formed to have an arcuate shape. Due to the smoothness and roundedness of the arcuate end, an annular sealing member arranged around the opening 72 (see FIG. 31) may be prevented from being damaged.

Figure 6:
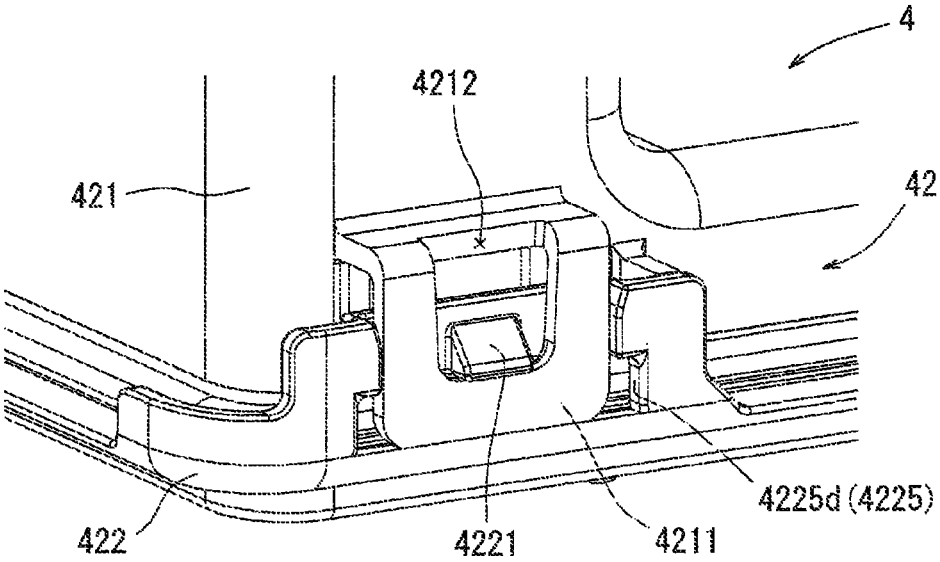
FIG. 6 is an enlarged view around an engagement portion and counter engagement portion of a fuel supply device according to another modification.

In order to prevent the recessed portion 4225 of the lower base 422 from being stuck on the edge around the opening 72 of the fuel tank 7, the recessed portion 4225 may be configured so as not to open towards the bottom surface side from the predetermined part (see FIG. 6). In FIG. 6 illustrating the third modification, a recessed portion 4225*d* is configured such that the lower end of the engagement portion 4211 abuts the lower base 422. However, it may be also possible to configure the recessed portion such that the lower end of the engagement portion 4211 does not abut the lower base 422.

According to the present embodiment, the bottom surface side of the base portion 42 is prevented from being stuck on the edge around the opening 72 of the fuel tank 7. In addition, the upper surface side of the base portion 42 is also configured to be prevented from being stuck on the edge around the opening 72 of the fuel tank 70.

As shown in FIGS. 2 and 27, in order to move the base portion 42 from outside the opening 72 of the fuel tank 7 and insert it into the opening 72, the base portion 42 is gradually inserted into the opening 72 from a side (insertion start side) of the base portion 42, which is first inserted into the opening 72 into the opening 72. As the insertion continues, the entire base portion 72 passes through the opening 72 and is finally arranged within the fuel tank 7 (see FIG. 27).

As shown in FIGS. 1 and 2, the pump 41, the pressure control valve 43, and the fuel residual amount detection device 48 are all arranged on the upper surface of the base portion 42. Therefore, to accommodate these structures, the upper surface of the base portion 42 has corresponding recesses and protrusions. Because these recesses/protrusions form steps, they may be stuck in the opening 72 (see FIG. 27) upon insertion. In the present embodiment, these steps are prevented from getting stuck on the edge around the opening 72 by providing a guide portion 8. Specifically, as shown in FIG. 2, a thin plate-like guide portion 8*a* is provided, which although located to the right of pressure control valve 43 in the y direction, in the XZ plane extends towards the pressure control valve 43 from a support portion 46 which is positioned directly above the pump 41. The guide portion 8*a* is configured to form an inclined surface up to a position higher than the upper end of the pressure control valve 43, and consequently higher than the steps formed by the recesses/protrusions. Therefore, the pressure control valve 43 or said recesses/protrusions are prevented from being stuck on the edge around the opening 72.

One end of the guide portion 8*a* extending from the support portion 46 is fixed to the support portion 46. However, the other end is not fixed. The guide portion 8*a* and the support portion 46 are integrally formed and are not configured as different components. More particularly, they are formed by filling and hardening resin in a mold for forming a support portion 46 with the guide portion 8*a* when molding resin.

Figure 7:
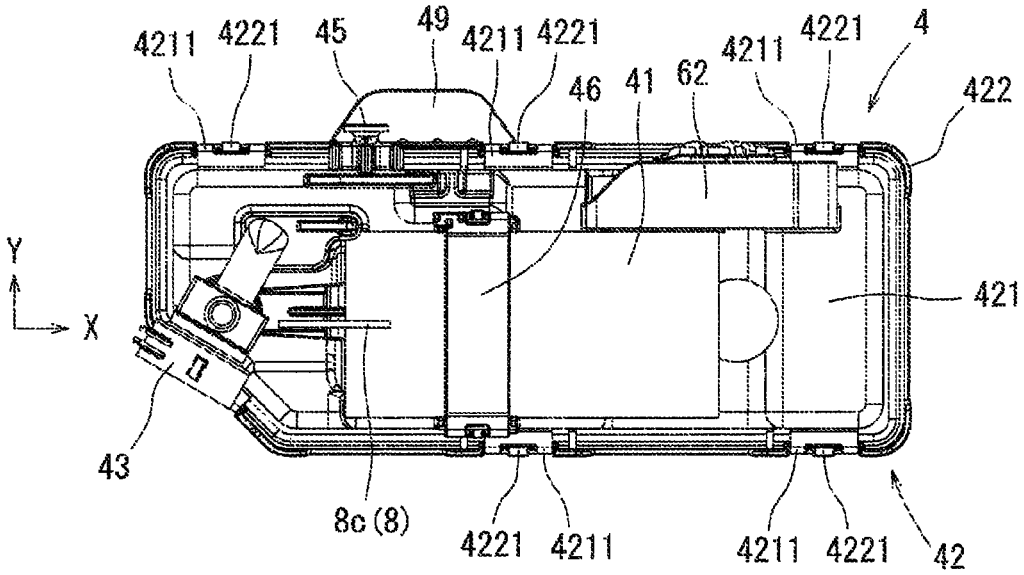
FIG. 7 is a plan view of a pump unit according to another modification.
Figure 8:
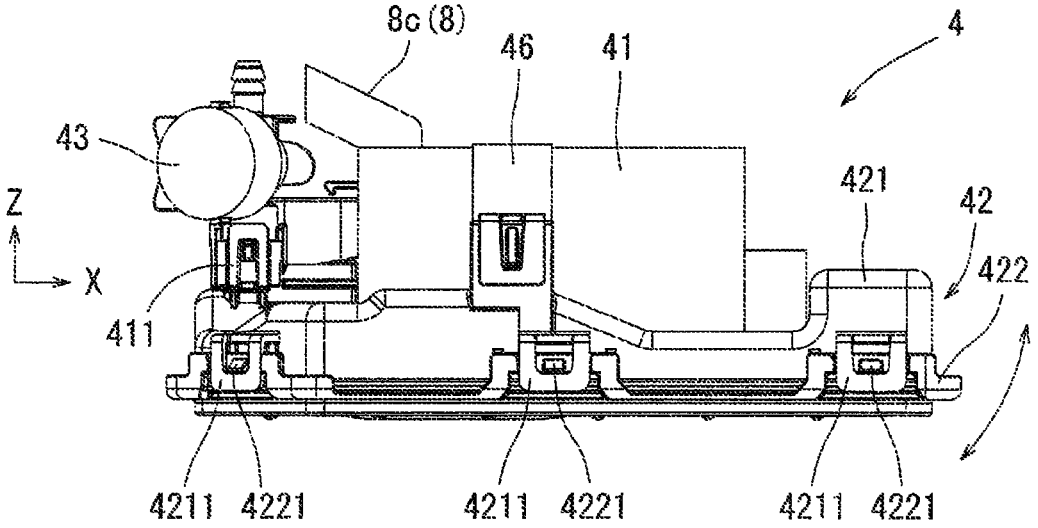
FIG. 8 is a right side view of the pump unit according to the modification of FIG. 7.

However, the guide portion 8*a* does not have to be integrally formed with the support portion 46. According to the modification shown in FIG. 7 and FIG. 8, the device may also be configured to have a guide portion 8*c* at the end of the pump 41 proximate to the pressure control valve 43.

Figure 9:
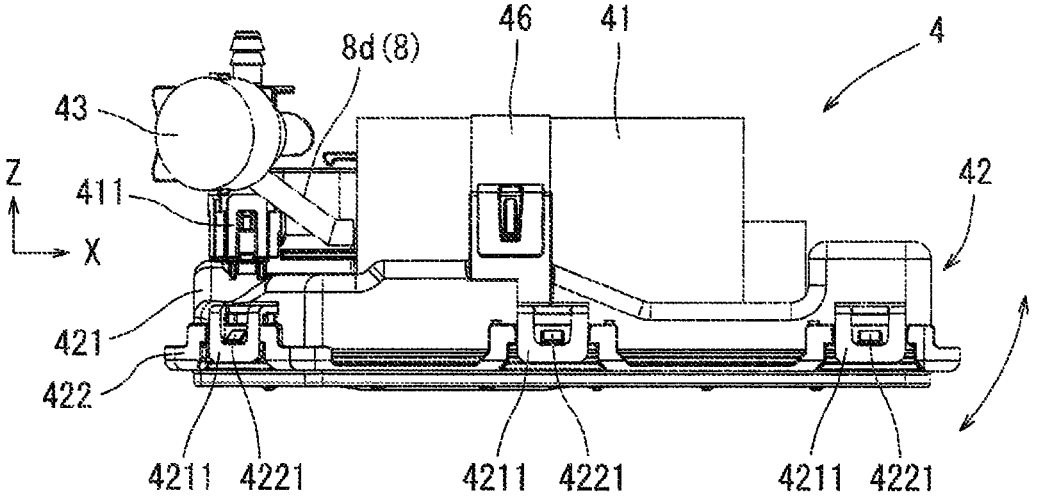
FIG. 9 is a right side view of a pump unit according to another modification.

Further, the guide portion 8 does not have to be fixed to the side of the pump 41. According to the modification as shown in FIG. 9, the guide portion 8 may also be configured with a thin plate-like portion extending from a case for the pressure control valve 43. The guide portion 8*d* shown in FIG. 9 is configured to extend from the case for the pressure control valve 43 slightly towards the lower leftward direction. The guide portion 8*d* shown in FIG. 9 is formed by filling and hardening resin in a mold capable of forming both a case for the pressure control valve 43 and a guide portion 8*d*.

Figure 10:
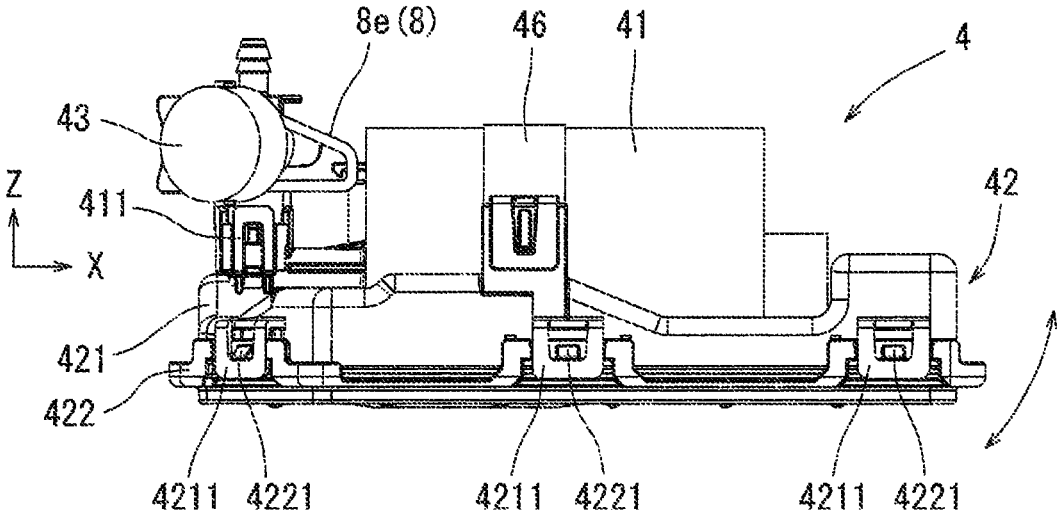
FIG. 10 is a right side view of a pump unit according to another modification.

Further, according to the modification shown in FIG. 10, the guide portion 8*e* can be formed through attaching a separate component to the case for the pressure control valve 43. In this case, the guide portion 8*e* is formed by attaching a member obtained by bending a wire member, to the case for the pressure control valve 43. The guide portion 8*e* has one part of the wire member which is positioned between the pressure control valve 43 and the pump 41. The guide portion 8*e* is configured to have an inclined surface as one part of the wire member is disposed so as to be inclined to the bottom surface of the pump unit 4.

The guide portion 8 may also be formed to extend from the base portion 42 but not from the pump 41 or the pressure control valve 43. According to the modification shown in FIG. 11, a part extending from the upper base 421 may be provided to serve as the guide portion 8. The guide portion 8*f* shown in FIG. 11 extends from the lateral surface of the upper base 421 and has an inclined surface at the leading end. The inclined surface of the guide portion 8*f* extends in the forward and downward direction from the pressure control valve 43. In this manner, the guide portion 8*f* may prevent recessed/protruding members positioned between the pump 41 and the pressure control valve 43, from protruding upwardly beyond the guide portion 8*f*.

Figure 11:
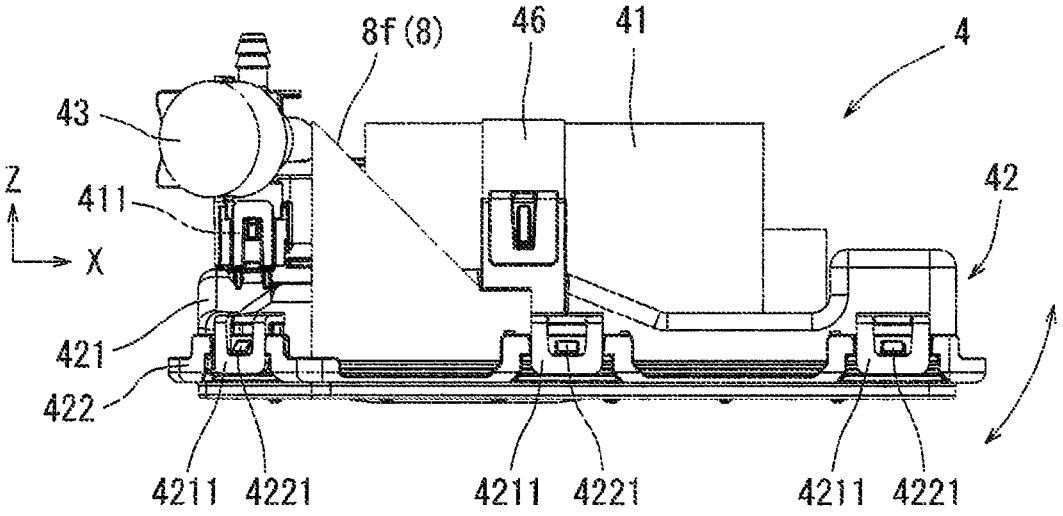
FIG. 11 is a right side view of a pump unit according to another modification.
Figure 12:
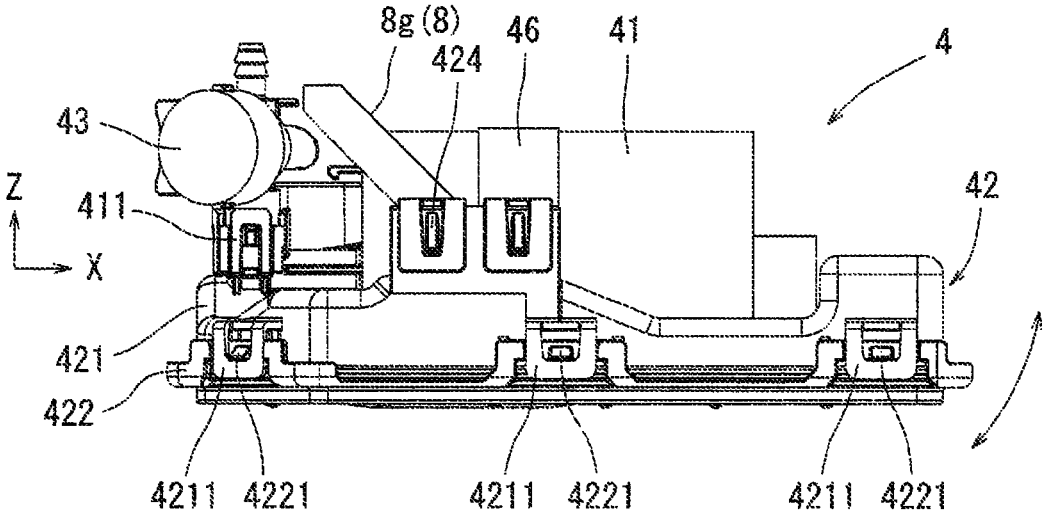
FIG. 12 is a right side view of a pump unit according to another modification.

The guide portion 8*f* shown in FIG. 11 is integrally formed at the upper base 421 so as not to be separated. However, according the modification shown in FIG. 12, the guide portion 8*g* may also be formed through attaching a separate component to the upper base 421. According to one example shown in FIG. 12, an attachment portion 424 for attaching a separate component is provided in a lateral position of the pump 41 within the upper base 421. The guide portion 8*g* is a separate piece formed to extend to the pressure control valve 43 through attachment to the attachment portion 424.

Additionally, in the present embodiment, the guide portion 8 is not limited to configurations where it extends from the top of the pump 41 directly upwardly in the XZ plane, without displacement in the Y direction when provided to the tank portion. For example, as a modification shown in FIG. 13, it is also possible for the guide portion 8*h* to be in a fixed configuration where it is positioned slightly downward from the top of the pump 41. According to the example shown in FIG. 13, the guide portion 8*h* is configured to extend backward and upward in the XZ plane while being inclined and also slightly deflected to the right in the Y direction.

Figure 13:
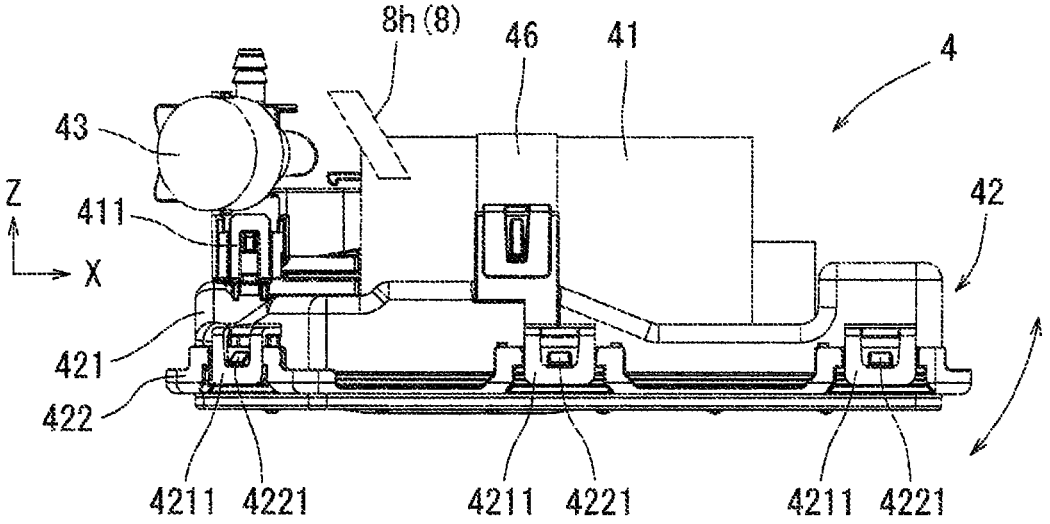
FIG. 13 is a right side view of a pump unit according to another modification.
Figure 14:
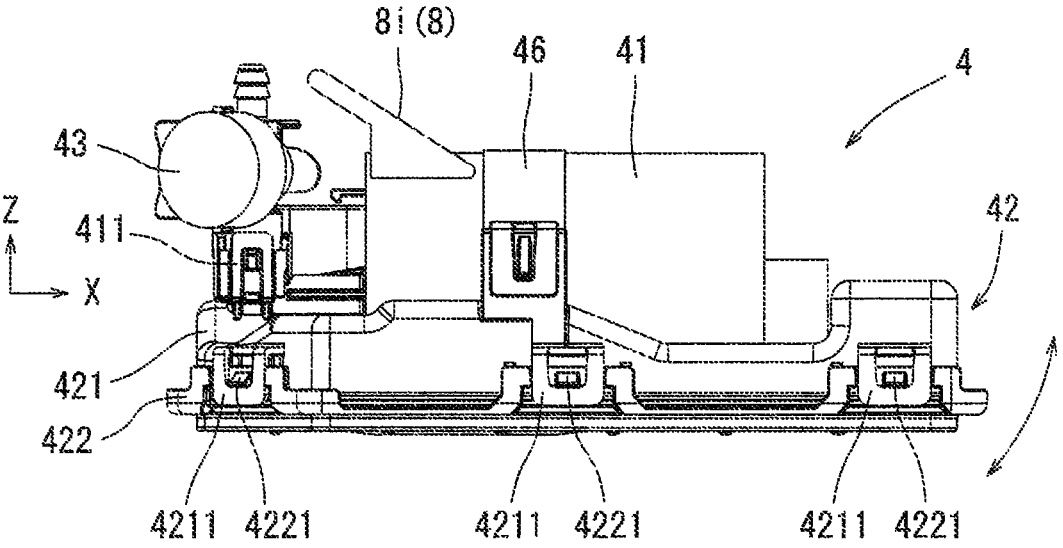
FIG. 14 is a right side view of a pump unit according to another modification.

Though according to the example shown in FIG. 13, the guide portion 8*h* is integrally formed with the pump 41, as shown in FIG. 14, a modification may be made where the guide portion 8*i* is formed through attaching a separately prepared component to the pump 41. With this structural configuration, the configurational flexibility of the guide portion 8*i* may be increased. Therefore, as shown in FIG. 14, a vertical length of the portion of 8*i* attached to the pump 41 as shown from a side view may be larger relative to the vertical length of the portion of 8*i* proximate to the pressure control valve 4, which may be smaller.

Figure 15:
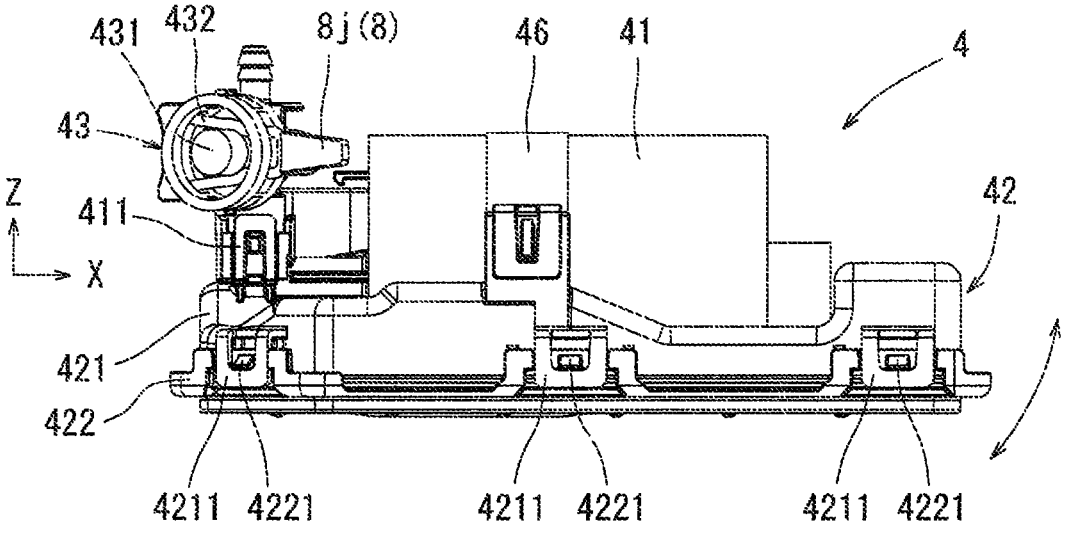
FIG. 15 is a right side view of a pump unit according to another modification.

Specific details are not described, however as shown in FIG. 15, in entire embodiments, an elastic clip 432 is attached to a case for the pressure controlling valve 43. The clip 432 can clamp the pressure control valve body 431 so that the case is attached to the pressure control valve body 431. Also, the guide portion 8 can be attached to the clip 432.

By way of example, as shown in FIG. 15, a thin plate-like member may be attached to the clip 432 so as to serve as a guide portion 8*j*.

As shown in FIG. 3, a step is also provided between the base portion 42 and the pump 41. A thin plate-like guide portion 8*b* is formed from an insertion start side (where the insertion start side is as described above) of the base portion 42 towards the end portion of the pump 41 proximate to the insertion start side in order to prevent the pump 41 from being caught to the edge around the opening 72 due to this step. The guide portion 8*b* is formed in the vicinity of the middle position of the base portion 42 with respect to the leftward and rightward directions and is formed to have a substantially rectangular configuration in a side view.

The guide portion 8 may be provided on the left and right ends of the base portion 42. In the case of the modification shown in FIG. 16, a guide portion 8*k* is provided to stand on the left side of the base portion 42. The guide portion 8*k* is formed to extend to the vicinity of the upper end of a mounting support portion 62, to which the fuel residual amount detection device 48 can be mounted. With this configuration of the guide portion, the fuel residual amount detection device 48 is prevented from colliding against the fuel tank 7. Further, in the case of the example shown in FIG. 16, the guide portion 8*k* is formed to extend from the upper base 421 and is not fixed to the attachment portion of the fuel residual amount detection device 48.

Figure 16:
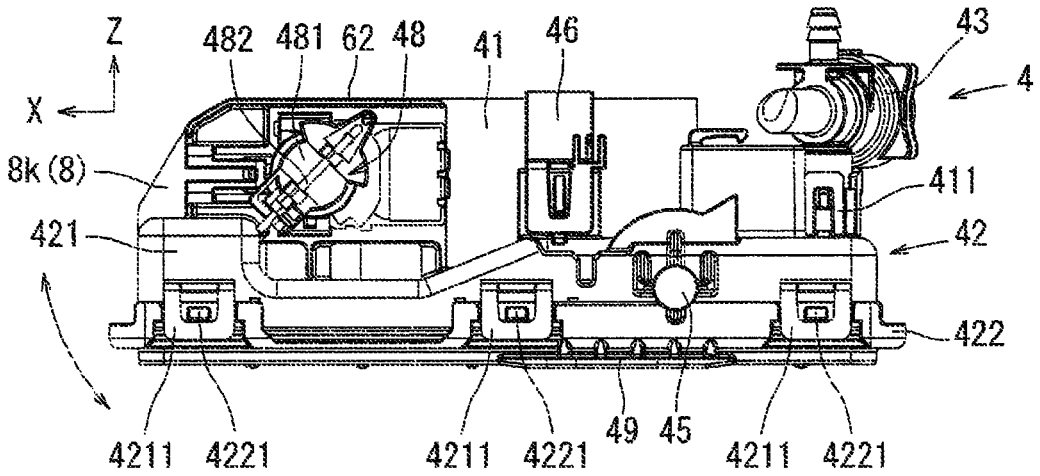
FIG. 16 is a left side view of a pump unit according to another modification.

The guide portion 8 may be configured to extend from the lower base 422 instead of the upper base 421 which was the embodiment shown in FIG. 16. In the case of the modification shown in FIG. 17, a strip plate guide portion 8*m* is provided to stand in front of the base portion 42, and is formed to extend to the vicinity of the upper end of the mounting support portion 62 for the fuel residual amount detection device 48. This guide portion configuration may prevent the fuel residual amount detection device 48 from colliding against the fuel tank 7. In the case of the embodiment shown in FIG. 17, an integral upwardly extending portion at the front end of the base 422 is provided. However, in a separate embodiment, a separate strip plate member may also be attached at the front end of the lower base 422.

Figure 17:
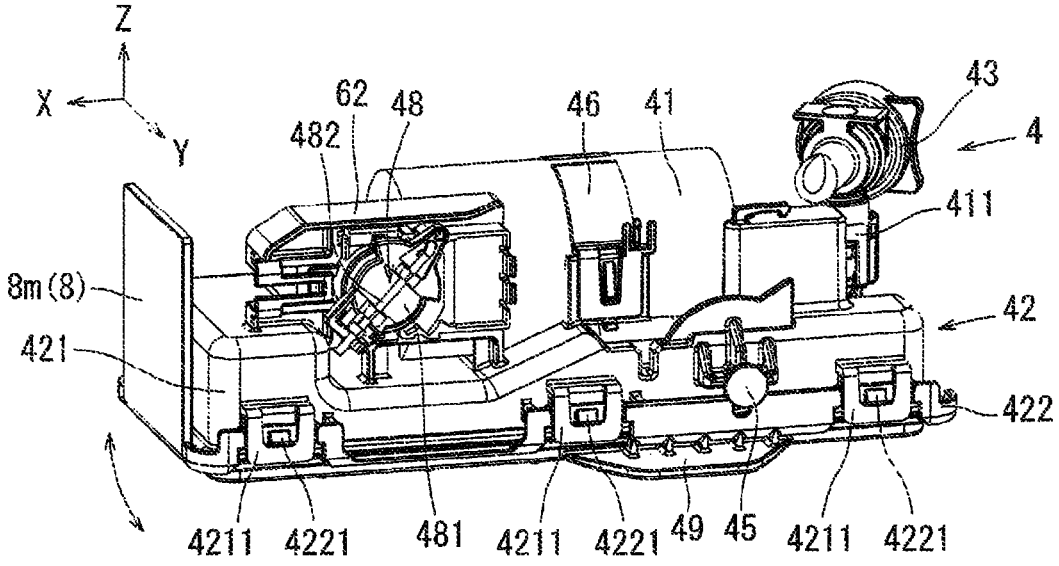
FIG. 17 is a perspective view of a pump unit according to another modification as seen from the left slant top (i.e. as viewed from a positive X, positive Y, and positive Z coordinate)
Figure 18:
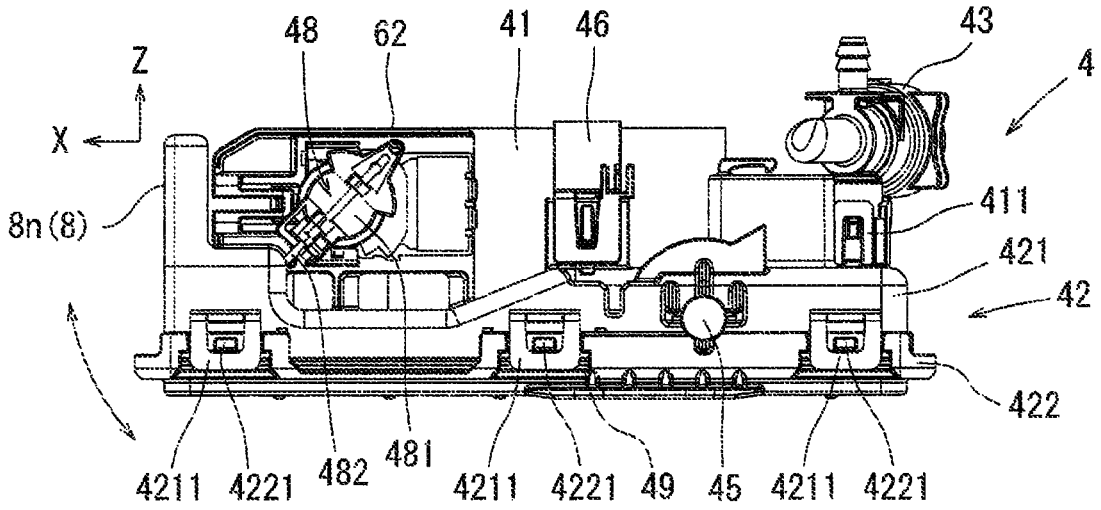
FIG. 18 is a left side view of a pump unit according to another modification.

As per the modification shown in FIG. 18, a guide portion 8*n* may be configured comprising a strip plate portion, which expands in the leftward and rightward directions and extends upwardly in front of the upper base 421, instead of a strip plate portion, which also expands in leftward and rightward directions but extends upwardly from the lower base 422 such as the guide portion 8*m* of FIG. 17. In the case of the embodiment shown in FIG. 18, the guide portion 8*n* is configured to have a strip plate portion slightly thicker in forward and backward directions. This configuration may prevent the fuel residual amount detection device 48 from colliding against the fuel tank 7.

Figure 19:
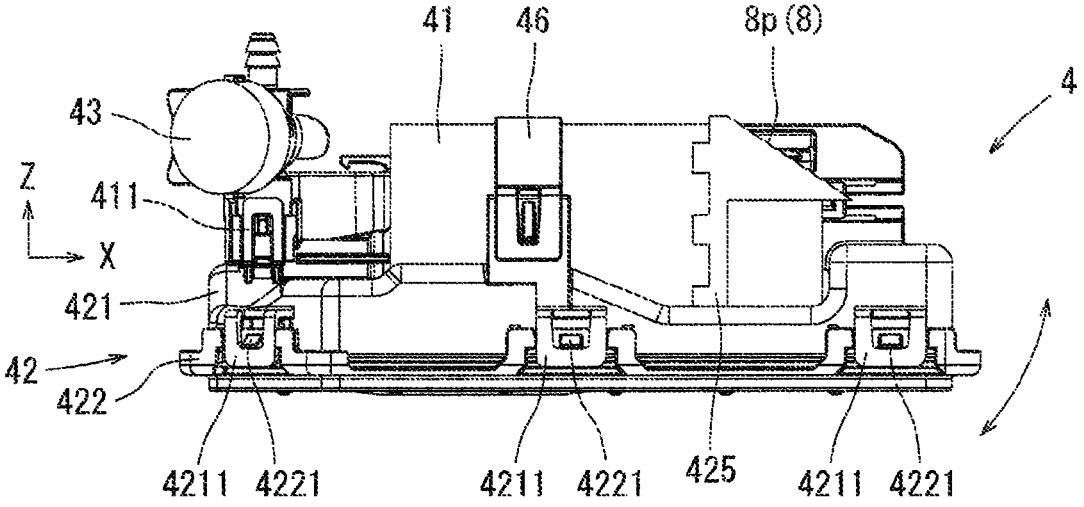
FIG. 19 is a right side view of a pump unit according to another modification.

As shown in FIG. 19, a cap 425 is provided at the front of the base portion 42 for fixing one end of the pump 41 in order to attach the pump 41 to the base portion 42. The cap 425 substantially covers one lateral surface of the pump 41 and is configured to hold an outer periphery of one end of the pump 41. In the embodiment shown in FIG. 19, a step is produced also between the cap 425 and the base portion 42. In the embodiment shown in FIG. 19, the cap 425 is provided with a triangular flat plate guide portion 8*p* as seen from a side view. This configuration may prevent the cap 425, which is a component of the step, from being stuck on the edge around the opening 72 of the fuel tank. The guide portion 8*p* extends forward from the cap 425 while being tapered. An inclined surface oriented to the front upward is formed on the guide portion 8*p*.

Figure 20:
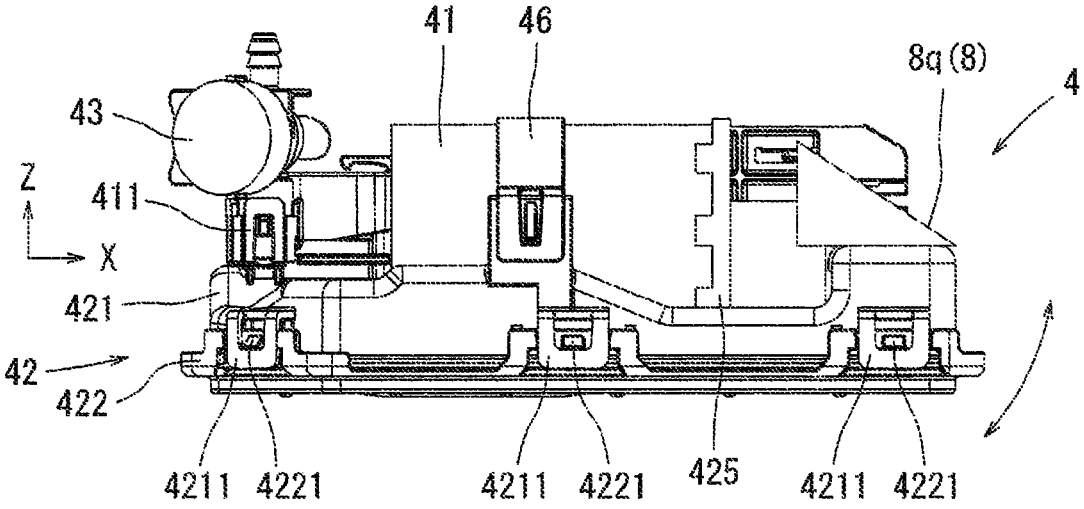
FIG. 20 is a right side view of a pump unit according to another modification.

As shown in FIG. 19, the guide portion 8 prevent the cap 425 from being stuck on the edge around the opening 72. Alternatively, as shown in FIG. 20, it is also possible to provide the guide portion 8 at the front of the upper base 421, separate from the cap. According to said modification shown in FIG. 20, the upper base 421 is provided with a triangular flat plate guide portion 8*q* as seen from a side view. The guide portion 8*q* is formed such that the distance from the bottom surface of the base portion 42 to the upper end portion of the cap 425 is slightly longer than the distance from the bottom surface of the base portion 42 to the upper end portion of the guide portion 8*q*. Even with this configuration, it is possible to prevent the pump 41 from being caught to the edge around the opening 72 because the guide portion 8*q* is formed as an inclined surface.

Figure 21:
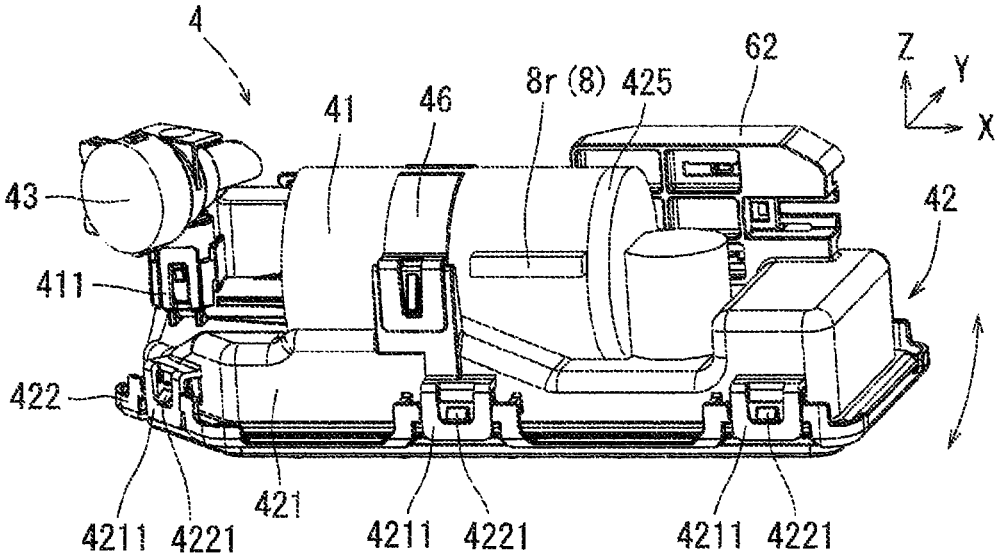
FIG. 21 is a perspective view of a pump unit according to another modification as seen from the right slant top (i.e. as viewed from a positive X, negative Y, and positive Z coordinate)

A strip support portion 46 is provided at substantially the middle of the substantially cylindrical pump 41 in its longitudinal direction. The support portion 46 is used to fix the pump 41 to the base portion 42 and a step is formed between a covered portion and a not-covered portion by the support portion 46. Therefore, if the guide portion 8 is not provided, the support portion 46 may be stuck on the edge around the opening 72. According to the modification shown in FIG. 21, a substantially rectangular parallelepiped guide portion 8*r* is provided at the step in order to prevent the support portion from being stuck on the edge around the opening 72. Although the guide portion 8*r* is configured to be formed at only one part of the pump 41, this guide configuration may prevent the support portion 46 from being stuck on the edge when the pump unit 4 is moved while the guide portion 8*r* abuts the edge around the opening 72. The guide portion 8*r* protrudes from the lateral surface of the pump 41 and has a protruding length in the Y-direction corresponding to the protruding length in the Y-direction of the supporting portion 46.

Figure 22:
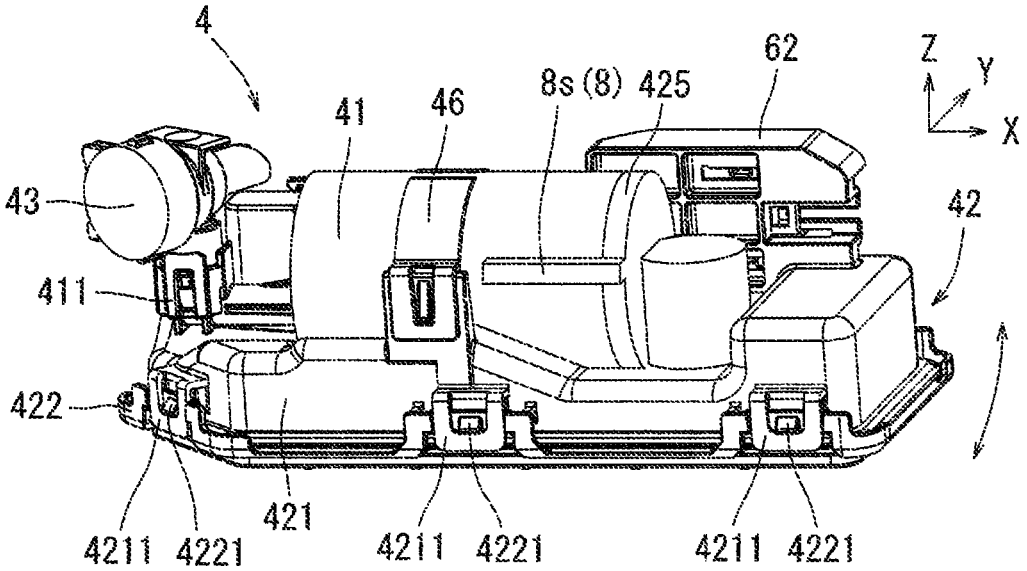
FIG. 22 is a perspective view of a pump unit according to another modification as seen from the right slant top (i.e. as viewed from a positive X, negative Y, and positive Z coordinate)

As to the modification shown in FIG. 22, a portion of the cap 425 may protrude toward the side in the Y-direction to form a guide portion 8*s* in order to prevent the support portion 46 from being stuck on the edge around the opening 72. The guide portion 8 is not limited to be formed as one part integrally with the cap 425 but may also in an embodiment be formed as a separate member which when attached to the cap 425 has the same configuration.

Figure 23:
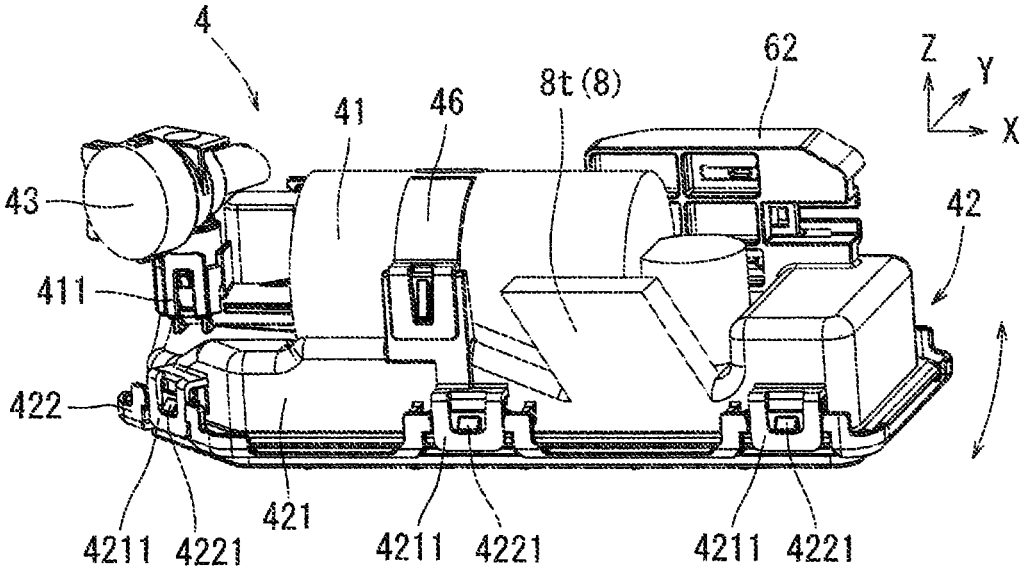
FIG. 23 is a perspective view of a pump unit according to another modification as seen from the right slant top (i.e. as viewed from a positive X, negative Y, and positive Z coordinate)

As to the modification shown in FIG. 23, one part of the upper base 421 may be extended as a guide portion to obtain a configuration where the support portion 46 is prevented from being caught or stuck on the edge around the opening 72. As shown in FIG. 23, a flat plate guide portion 8*t* formed substantially as a parallelogram in a side view is provided as a part of the upper base 421. The guide portion 8*t* is formed to protrude further than the support portion 46, and thus it may prevent said support portion 46 from being stuck on the edge around the opening 72.

It is not necessary to configure the guide portion 8 to be provided at only one location of one component. As the modifications in FIGS. 24 to 26 demonstrate, the guide portions 8 may be provided at a plurality of locations of one component in order to prevent the support portion 46 from being stuck on the edge around the opening 72. According to the example shown in FIG. 24, two guide portions 8*u* are configured to extend from the upper base 421. As shown in FIG. 25, the guide portions 8*u* are configured to have an inclined surface in a side view looking at the XZ plane wherein an upper end of the inclined surface is configured to be positioned higher than the support portion 46. These guide portions 8*u* are not limited in configuration as forming one integral part with the upper base but may ensure the same function in a separate embodiment by being attaching as a separate component to the upper base 421.

Figure 24:
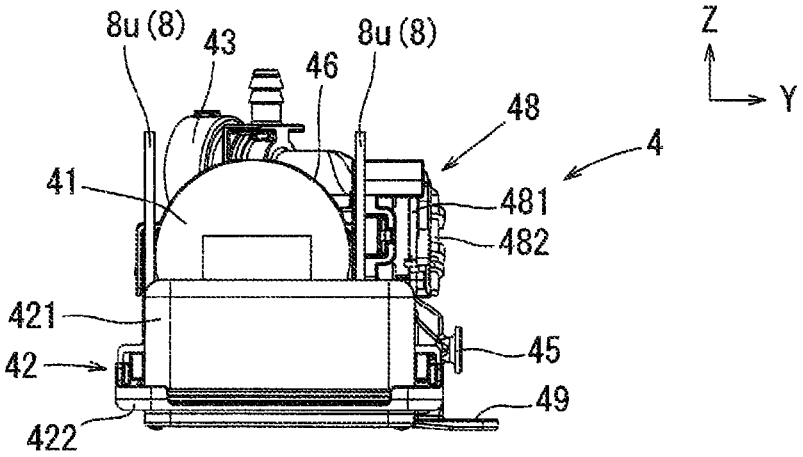
FIG. 24 is a front view of a pump unit according to another modification.
Figure 25:
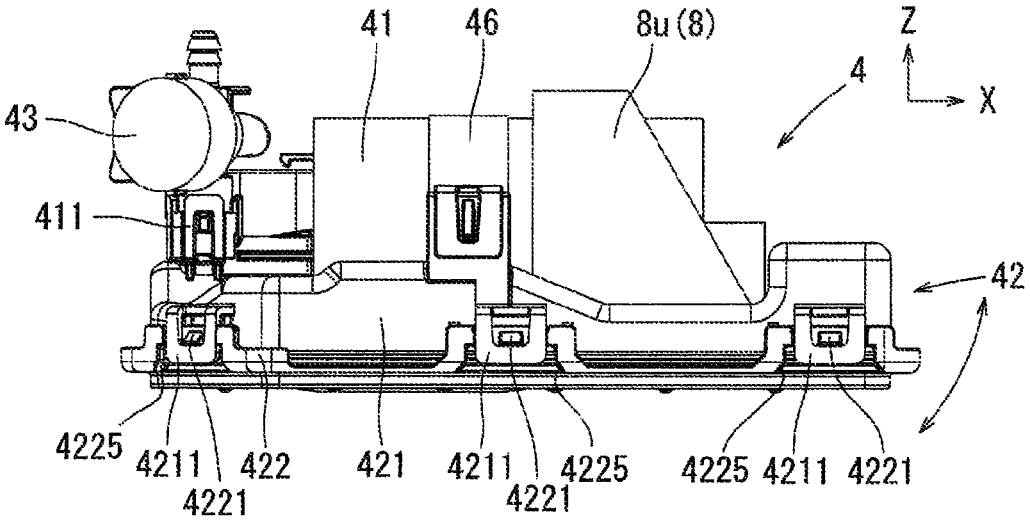
FIG. 25 is a right side view of a pump unit according to another modification.
Figure 26:
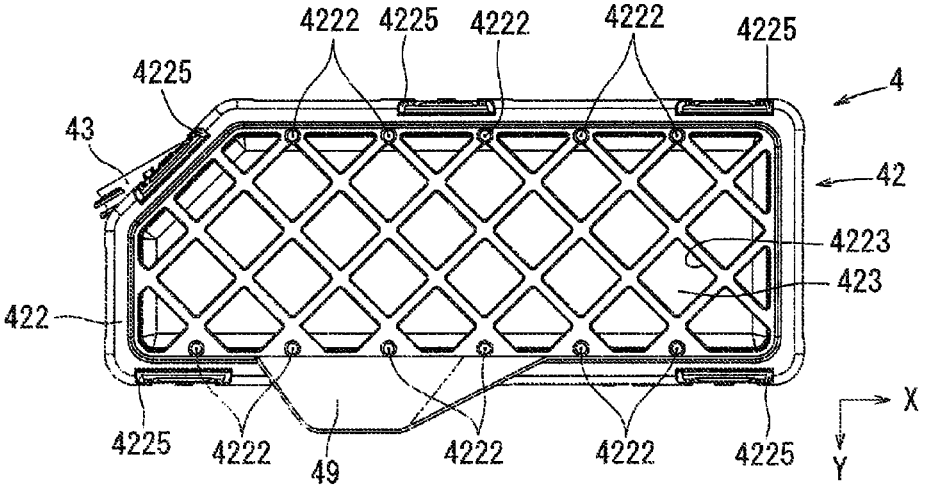
FIG. 26 is a bottom view of the pump unit according to the modification of FIG. 25.

FIG. 26 illustrates a bottom surface side of the pump unit 4 according to the modification shown in FIG. 24 and FIG. 25. As understood from FIG. 26, an engagement portion 49 provided at the base portion 42 is configured in approximately a trapezoidal shape such that an inclination angle formed by one of the sides proximal to the insertion start side (where insertion start side is as described above) forms an angle of substantially 60 degrees with respect to the lateral surface of the insertion start side of the lower base portion 422. Because this angle is formed to be equal to and more than 45 degrees as shown by a two-dot chain line in FIG. 26 and equal to and less than 90 degrees, the engagement portion 49 is prevented from getting stuck on the edge around the opening 72. The inclination angle formed by the opposite side is substantially 45 degrees.

Because the pump unit 4 is formed to have a configuration according to the modification as shown in FIGS. 24 to 26, the pump unit 4 can be moved while the guide portions 8*u* abut the edge of the opening 72 of the fuel tank 7. Further, when the pump unit 4 is moved in this state, the pump unit 4 can be moved without the support portion 46 getting stuck on the edge around the opening 72. Furthermore, the end surface of the engagement portion 49 is also configured such that it does not get caught or stuck on the edge around the opening 72. Therefore, the pump unit 4 can be smoothly inserted into the opening 72 of the fuel tank. If only one of the guide portions 8*u* provided in a position as shown in FIG. 24 is sufficient to serve a guide function, it is not necessary to provide two guide portions 8*u*. It is also possible to configure the mounting support portion 62 for the fuel residual amount detection device 48 to have a dual function as a guide portion 8.

As commonly known in the prior art, the leading end of any element resembling a rod of the connection portion of the present invention is often of a substantially planar shape, where it can often catch or get stuck on the edge of a fuel tank when being inserted, such that the fuel supply device may not be attached smoothly. Furthermore, such a shape can also strike a sealing member such as a ring arranged around the opening, and can damage the sealing member. Therefore, the embodiment shown in FIG. 2 etc. adopts a configuration to avoid the leading end of the rod member 35 being struck to the fuel tank 7 etc. More particularly, the leading end of the rod member 35 is configured so as not to extend below the joint portion 36 when the joint portion 36 is positioned in a lower end. In other words, the leading end 351 of the rod member 35 is configured to be surrounded by the joint portion 36 (see FIGS. 2 and 27. Accordingly, the leading end 351 of the rod member 35 may be prevented from being stuck to the edge around the opening 72 of the fuel tank 7 and further damage to the seal member may be prevented by configuring the device such that the leading end 351 of the rod member 35 does not extend below the joint portion 36.

The joint portion 36 as shown in FIG. 2 is formed with a guide surface 361 which is comprises a surface inclined with respect to an axis of the rod member 35 in the Z direction. The pump unit 4 may be moved toward a predetermined position when the joint portion 36 is moved where the guide surface 361 is abuts the edge around the opening 72 of the fuel tank 7.

The leading end of the rod member 35 is configured not to extend below the joint portion 36 as shown in FIG. 2 in order to avoid damage to the seal member and tank as described above, which may be caused by the leading end 351 of the rod member 35 when the fuel supply device 1 is attached to the fuel tank 7. Therefore, the leading end 351 of the rod member 35 does not have to be surrounded by the joint portion 36 except when the leading end 351 of the rod member 35 abuts the fuel tank 7 etc. Thus, it is possible to adopt a configuration, where the leading end 351 of the rod member 35 extends below the joint portion 36 if the leading end 351 of the rod member 35 would not abut the fuel tank 7 etc. e.g. when the fuel supply device 1 is fully inserted and attached to the fuel tank 7 as shown in FIG. 27. With this configuration, the extending/retracting property of the connecting portion 3 can be sufficiently ensured even though the joint portion 36 is not configured to extend in a vertical direction. Further, it is also possible to configure the device such that the leading end 351 of the rod member 35 would always not extend below the joint portion 36.

As described above, because in the commonly known prior art, the leading end of any element resembling a rod of the connection portion of the present invention is often of a substantially planar shape, it may damage the seal member. This damage may be prevented by forming a lower end of the rod member 35 to have a curved surface. For example, according to the modification shown in FIG. 28, the damage can be prevented, when a leading end 351*b* of the rod member 35 is formed to have a curved surface with a spherical crown shape. In this case, the leading end 351*b* of the rod member 35 does not have to be surrounded by the joint portion 36 when the joint portion 36 is positioned at the lower end position. However, it is not limited to this embodiment and in another embodiment 351*b* may also be configured to be surrounded by the joint portion 36.

Figure 28:
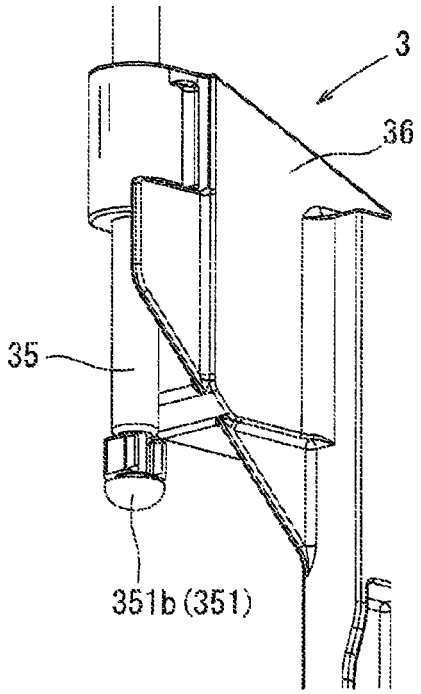
FIG. 28 is a perspective view illustrating around a rod member according to another modification.
Figure 29:
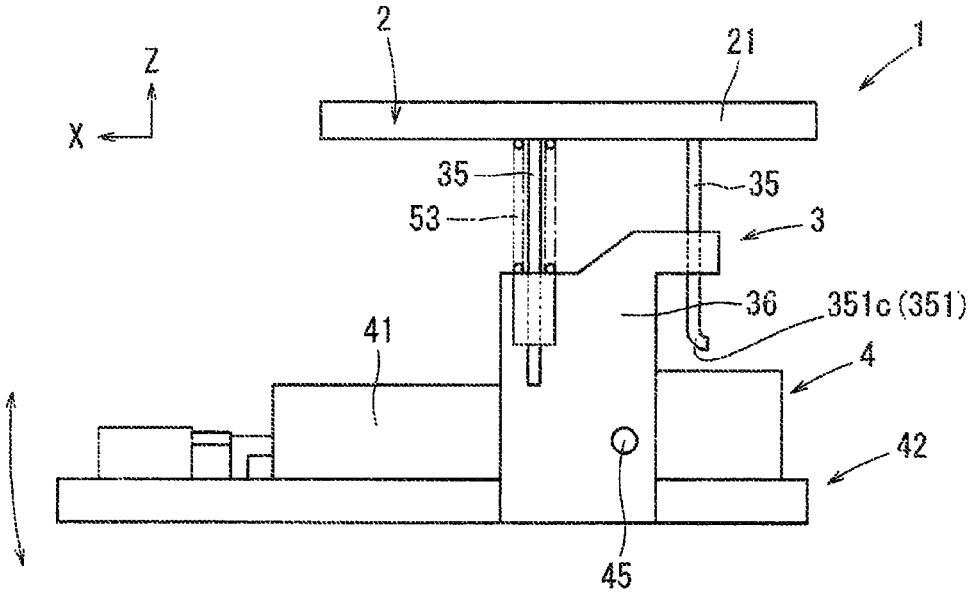
FIG. 29 is a schematic left side view of a pump unit according to another modification.

The leading end 351 of the rod member 35 is also not limited to only be formed to have a curved surface with a spherical crown shape as shown in FIG. 28, but it is also possible to form the lower end of the rod member 35 to have a different curved surface by bending a leading end 351*c* of the rod member 35 as shown in the modification in FIG. 29. According to the embodiment shown in FIG. 29, the device is configured to have two rod members 35, a spring 53 attached to the front rod member 35 and a curved surface formed at the lower end of the rear rod member 35. Alternatively, two rod members 35 and the joint portion 36 may be symmetrically flipped in the X-direction about the vertical centerline of the joint portion 36.

Figure 30:
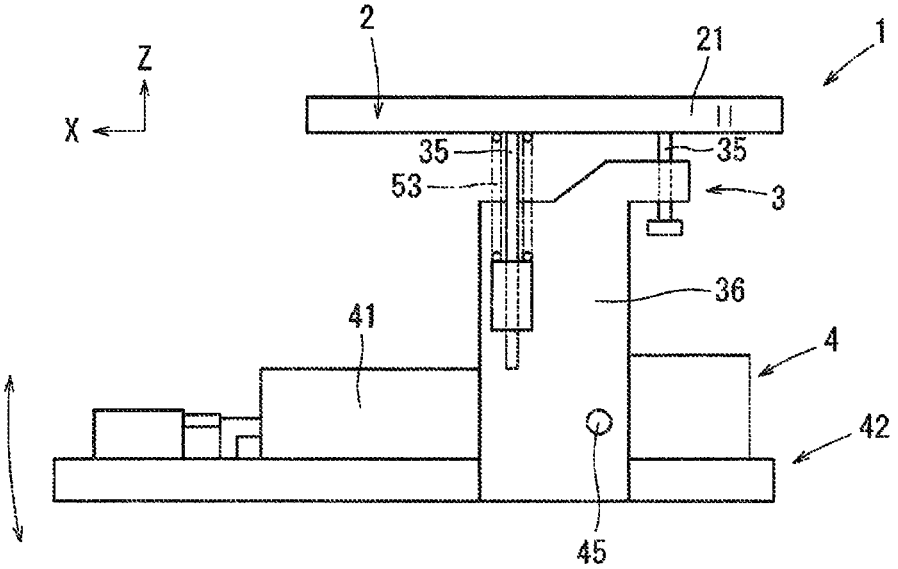
FIG. 30 is a schematic left side view of a pump unit according to another modification.

Further, it may be possible to prevent the leading end of the rod member 35 from striking the edge around the opening 72 of the fuel tank 7 by forming the rod member 35 on the side to protrude below the joint portion 36 to be shorter in vertical length than the rod member 35 on the side not to protrude from the joint portion 36. Alternatively to the embodiment shown in FIG. 30, two rod members 35 and the joint portion 36 may be symmetrically flipped in in the X-direction about the vertical centerline of the joint portion 36.

The fuel supply device 1 in the present embodiment has, for example, a guide portion 8 that is configured such that it prevents parts in the vicinity of the bottom surface and the upper surface of the pump unit 4 from being caught to the opening 72. Therefore, the fuel supply device 1 is configured to facilitate the insertion of the pump unit 4 into the opening 72.

A plate member is used for the guide portion 8 for the fuel supply device 1 according to the above embodiment such that the increase of materials may be prevented compared to a cover-type guide portion configured to cover the pump 41 and the pressure control valve 43. The guide portion 8 is a plate and its volume is relatively small. Consequently, the fuel may be easily distributed to the side of the pump 41 above the base portion 42 so that the inflow property of the fuel around the pump unit 4 can be ensured.

Further, according to the embodiment of the fuel supply device 1, the plate member which serves as the guide portion 8, is not fixed between two members constituting a step to be connected but rather is attached to extend from one member. Accordingly, it is configured to allow the relative movement between members.

According to the fuel supply device 1 of the above embodiment, both pump unit 4 and connecting portion 3 are prevented from being caught to the edge around the opening 72. Therefore, the pump unit 4 and the connecting portion 3 can be smoothly attached to the fuel tank 7.

While the embodiments of invention have been described with reference to specific configurations, it will be apparent to those skilled in the art that many alternatives, modifications and variations may be made without departing from the scope of the present invention. Accordingly, embodiments of the present invention are intended to embrace all such alternatives, modifications and variations that may fall within the spirit and scope of the appended claims. Embodiments of the present invention should not be limited to the representative configurations, but may be modified, for example, as described below.

For example, a canister portion filled with an adsorbent may be provided to the cover member. In this case, a connecting portion can be configured to connect the canister portion and the pump unit. Further, although the cover member is provided with the canister portion, the connecting portion may be configured to connect the set plate portion and the pump unit.

The filter member is not necessarily placed at the base portion, where it is possible to configure said portion without the filter member. In this case, the filter member may be arranged at any other portion than the base portion. If the fuel to be sucked by the pump is maintained clean, the filter member itself does not have to be present in the fuel supply device.

The configuration for movably connecting the connecting portion relative to the pump unit is not limited to the connection of the above embodiment made by inserting the connecting shaft formed as part of the pump unit into the connecting hole formed as part of the connecting portion. Alternatively, it is also possible to configure said connection by inserting the connecting shaft formed as part of the connecting portion into the connecting hole formed as part of the pump unit.

It is also not necessary to configure the fuel supply device to be inserted into the opening in the order where the pump is inserted first and is then followed by the pressure control valve. Instead, the pump may be inserted into the opening after the pressure control valve is inserted. Further, the fuel residual amount detection device does not have to be arranged on the left side of the pump but may be arranged on the right side and also may be arranged on the front side or the rear side of the pump.

A part serving as a guide portion is not limited to be configured to have a shape of a bent wire or a plate but may be formed to have various configurations. However, if the guide portion is formed as mentioned above, the configuration is simple and the necessary rigidity can be easily secured. The case covering the entire upper surface side of the base portion, on which the pump and the pressure control valve are arranged, is different from the guide portion defined in the present specification.

The predetermined part of the recessed portion as defined in the above embodiment, where an interval between the opposing planes is gradually increased from a predetermined location at the recessed portion to the bottom surface side, is not limited to an isosceles trapezoid configuration when seen from a side view. For example, instead of an isosceles trapezoid, it may be configured to be a non-isosceles trapezoid and the opposing plane may be configured to form a bent surface but not a planar shape. More particularly, at least one of the parts, where the interval between the planes is gradually increased from the predetermined location to the opposing plane toward the bottom surface side (the part corresponding to a leg part of the isosceles trapezoid in a side view in the embodiment), may also be configured in an arcuate shape as seen from a side view. Furthermore, either one of the planes may be provided to be orthogonal to the bottom surface of the pump unit, while the other one of the planes may be provided to be inclined with respect to the bottom surface.

Moreover, as per the vehicle, the invention is not limited in scope to automobiles. It may also be used in a vehicle that flies in the air (e.g. an airplane or a helicopter), or that moves over the sea or in the sea (e.g. a ship or a submarine).

The invention claimed is:

1. A fuel supply device comprising:

a cover member which is attached to an opening of a fuel tank;

a pump unit comprising a pump and a base portion;

a connecting portion configured to connect the cover member and the pump unit;

a connecting shaft which connects the pump unit to the connecting portion; and a connecting hole into which the connecting shaft is inserted to thereby allow the pump unit to move relative to the connecting portion, wherein the pump unit base portion includes an upper base on which the pump is placed, as well as a lower base, the upper base and the lower base are coupled together via an engagement portion of the upper base which complementarily fits with a counter engagement portion surrounded by a recessed portion formed on the side of the lower base, the recessed portion has a pair of planes opposing each other and oriented toward a bottom surface of the lower base from a predetermined position, and the recessed portion is configured such that the horizontal distance between the pair of the planes is gradually increased as the planes vertically approach the bottom surface.

2. The fuel supply device of claim 1, wherein a step is formed on an upper surface side of the upper base, and a guide portion is configured to prevent the step from being stuck on an edge around the opening of a fuel tank.

3. The fuel supply device of claim 2, wherein the guide portion has an inclined surface inclined with respect to the bottom surface of the lower base.

4. The fuel supply device of claim 1, wherein the connecting portion includes a rod member with one end connected to the cover member and a joint which is connected to the rod member and slidably movable along the rod member in a vertical direction, and the leading end of the rod member is positioned above a lower end of the joint when the joint is positioned at a lower end position.

5. The fuel supply device of claim 4, wherein the joint includes a guide surface inclined with respect to the vertical axis of the rod member, and when the joint is moved with the guide surface abutting to the fuel tank, the pump unit can be moved toward a predetermined position.

6. The fuel supply device of claim 4, wherein the leading end of the rod member is always positioned above the lower end of the joint at all times before and after insertion into a fuel tank.

7. The fuel supply device of claim 1, wherein the connecting portion includes a rod member with one end connected to the cover member and a joint which is slidably connected to the rod member, and a lower end of the rod member is formed as a curved surface.

8. The fuel supply device of claim 1, wherein the fuel supply device is inserted into the fuel tank while being moved in leftward or rightward direction.

9. The fuel supply device of claim 1, wherein the engagement portion of the upper base comprises a U-shaped flange extending from a lateral surface of the upper base in the XZ plane.

10. The fuel supply device of claim 9, wherein the U-shaped flange of the engagement portion engages with the counter engagement and the recessed portion where the counter engagement portion comprises a triangular prismatic shaped protrusion in the YZ plane such that said protrusion can be inserted into a hole formed by the U-shape flange of the engagement portion, wherein the engagement portion is fitted fixedly within the cavity formed by the recessed portion when the engagement and counter engagement portions are in a complementary fit configuration.

11. The fuel supply device of claim 10, wherein the device is configured such that when the engagement and counter engagement portions are in a complementary fit configuration, the protruding length of the counter engagement portion and the flange of the engagement portion correspond to the same length in the outward Y direction perpendicular to the XZ plane, where, the flange and an outward tip of the counter engagement portion are coplanar with each other in the XZ plane, wherein said configuration forms a feature which can prevent the protrusion and the flange from getting caught on an edge around the opening of a fuel tank when the device is moved or inserted relative to the tank.

12. The fuel supply device of claim 1, wherein the device includes a guide portion in the shape of a bent wire or a plate which has an inclined surface so as to be inclined relative to the bottom surface of the pump unit, which prevents edges and steps on the upper and lower surfaces of the base portion from being caught on an edge around the opening of a fuel tank when the device is moved.

13. The fuel supply device of claim 1, wherein the device includes a guide portion formed as part of the base portion, extending from a lateral surface of the base portion, where said guide portion has an inclined surface towards the leading end of the base portion in a substantially triangular prismatic shape, preventing steps and other recessed and protruding members on the base portion from protruding upwardly beyond the guide, which serves to prevent the said steps and other recessed and protruding members from getting caught or stuck on the edge around the opening of a fuel tank when the device is moved or inserted relative to the tank.

14. The fuel supply device of claim 1, wherein a strip support portion is provided circumferentially around the pump of the pump unit in the middle of its longitudinal direction, and is used to fix the pump to the base portion of the pump unit, wherein thus a rectangular parallelepiped guide portion is provided proximately adjacent to the strip support portion on the pump, which prevents the strip support portion and any steps formed therein from being caught or stuck on the edge around the opening of a fuel tank when the device is moved or inserted relative to the tank.

15. The fuel supply device of claim 1, wherein the width of the recessed portion is formed to increase gradually from a predetermined part along the recessed portion as it vertically approaches the bottom surface of the lower base, wherein said predetermined part is configured to be of an isosceles trapezoidal shape as seen from a side view, where the top of this shape in the Z direction is the same height and corresponds with the lower end position of the flange of the engagement portion, wherein said trapezoidal shape thus minimizes the chances of the recessed portion being caught on the edge around the opening of a fuel tank when the device is moved or inserted relative to the tank.

16. The fuel supply device of claim 1, wherein an engagement portion is provided at the base portion of the pump unit, configured in approximately a trapezoidal shape extending from a lateral side of the base portion which contacts on a bottom face of a fuel tank when the fuel supply device is inserted into such a tank, wherein an inclination angle formed by one of the legs of the trapezoid proximal to the connecting portion forms an angle of substantially 45 degrees, and the leg non-proximal to the connecting portion forms an angle of substantially 60 degrees with respect to the lateral surface of the lower base portion in the XY plane, wherein due to the specific angle range, the engagement portion is prevented from getting caught or stuck on the edge around the opening of such a fuel tank, when the device is moved or inserted relative to the tank.

17. A fuel supply device comprising:

a cover member which is attached to an opening of a fuel tank;

a pump unit comprising a pump and a base portion, a bottom surface, and an upper surface, wherein the upper surface comprises a step;

a connecting portion configured to connect the cover member and the pump unit;

a connecting shaft which connects the pump unit to the connecting portion; and a connecting hole into which the connecting shaft is inserted to thereby permit the pump unit to move relative to the connecting portion; and a guide portion configured to prevent the upper surface from being stuck on an edge around the opening of a fuel tank, wherein the guide portion includes an inclined surface inclined with respect to the bottom surface.

18. A fuel supply device comprising:

a cover member attachable to an opening of a fuel tank;

a pump unit comprising a pump and a base portion;

a connecting portion configured to connect the cover member and the pump unit;

a connecting shaft which connects the pump unit to the connecting portion; and a connecting hole into which the connecting shaft is inserted to thereby enable the pump unit to move relative to the connecting portion, wherein the connecting portion includes a rod member with one end connected to the cover member and a joint which is connected to the rod member and slidably movable along the rod member in a vertical direction, and the leading end of the rod member is positioned above a lower end of the joint when the joint is positioned at a lower end position.

19. A fuel supply device comprising:

a cover member which is attached to an opening of a fuel tank;

a pump unit comprising a pump and a base portion;

a connecting portion configured to connect the cover member and the pump unit;

a connecting shaft which connects the pump unit to the connecting portion; and a connecting hole into which the connecting shaft is inserted to enable the pump unit to move relative to the connecting portion, wherein the connecting portion includes a rod member with one end connected to the cover member and a joint which is connected to the rod member and slidably movable along the rod member in a vertical direction, and a lower end of the rod member is formed in a curved surface.

20. The fuel supply device of claim 19, wherein the rod member has a leading end which comprises a spherical crown shape which through its spherical and rounded nature can prevent damage to a seal member of a fuel tank in all three dimensions.

* * * * *